US008981338B2

(12) United States Patent
Fuke et al.

(10) Patent No.: US 8,981,338 B2
(45) Date of Patent: Mar. 17, 2015

(54) SEMICONDUCTOR PHOTOCATHODE AND METHOD FOR MANUFACTURING THE SAME

(71) Applicants: Sanken Electric Co., Ltd., Niiza-shi, Saitama (JP); Hamamatsu Photonics K.K., Hamamatsu-shi, Shizuoka (JP)

(72) Inventors: Shunro Fuke, Hamamatsu (JP); Tetsuji Matsuo, Niiza (JP); Yoshihiro Ishigami, Hamamatsu (JP); Tokuaki Nihashi, Hamamatsu (JP)

(73) Assignees: Sanken Electric Co., Ltd., Niiza-shi, Saitama (JP); Hamamatsu Photonics K.K., Hamamatsu-shi, Shizuoka (JP)

( * ) Notice: Subject to any disclaimer, the term of this patent is extended or adjusted under 35 U.S.C. 154(b) by 0 days.

(21) Appl. No.: 13/849,139

(22) Filed: Mar. 22, 2013

(65) Prior Publication Data

US 2013/0248815 A1 Sep. 26, 2013

Related U.S. Application Data

(60) Provisional application No. 61/635,972, filed on Apr. 20, 2012.

(30) Foreign Application Priority Data

Mar. 23, 2012 (JP) ..... 2012-068132

(51) Int. Cl.
*H01J 1/308* (2006.01)
*H01J 1/34* (2006.01)
(Continued)

(52) U.S. Cl.
CPC . *H01J 1/308* (2013.01); *H01J 1/34* (2013.01); *H01J 9/12* (2013.01); *H01J 31/507* (2013.01); *H01J 9/025* (2013.01)
USPC ..... 257/11; 257/10; 257/17; 257/184; 257/189; 257/183; 438/20; 438/478

(58) Field of Classification Search
CPC ..... H01J 1/308; H01J 9/02
USPC ..... 257/11, 10, 17, 184, 189, 183; 438/20, 438/478
See application file for complete search history.

(56) References Cited

U.S. PATENT DOCUMENTS 4,605,600 A 8/1986 Niigaki et al.
5,359,187 A * 10/1994 Weiss ..... 250/214 VT
(Continued)

FOREIGN PATENT DOCUMENTS

JP S60-235478 11/1985
JP 2889291 5/1999
(Continued)

OTHER PUBLICATIONS

S. Fuke et al., "Development of UV-photocathodes using GaN film on Si substrate", Proc. SPIE 6894,68941F-1-68941F-7, 2008.

*Primary Examiner* — Thao X Le
*Assistant Examiner* — Sheng Zhu
(74) *Attorney, Agent, or Firm* — Drinker Biddle & Reath LLP

(57) ABSTRACT

A semiconductor photocathode includes an $Al_XGa_{1-X}N$ layer ($0 \leq X < 1$) bonded to a glass substrate via an $SiO_2$ layer and an alkali-metal-containing layer formed on the $Al_XGa_{1-X}N$ layer. The $Al_XGa_{1-X}N$ layer includes a first region, a second region, an intermediate region between the first and second regions. The second region has a semiconductor superlattice structure formed by laminating a barrier layer and a well layer alternately, the intermediate region has a semiconductor superlattice structure formed by laminating a barrier layer and a well layer alternately. When a pair of adjacent barrier and well layers is defined as a unit section, an average value of a composition ratio X of Al in a unit section decreases monotonously with distance from an interface position between the second region and the $SiO_2$ layer at least in the intermediate region.

19 Claims, 24 Drawing Sheets

(51) Int. Cl.

| | |
|---|---|
| ***H01J 9/12*** | (2006.01) |
| ***H01J 31/50*** | (2006.01) |
| ***H01J 9/02*** | (2006.01) |

(56) References Cited

U.S. PATENT DOCUMENTS

| | | | | |
|---|---|---|---|---|
| 5,697,826 | A * | 12/1997 | Kim et al. | 445/58 |
| 6,580,215 | B2 * | 6/2003 | Nihashi | 313/542 |
| 7,525,131 | B2 | 4/2009 | Sumiya et al. | |
| 7,615,389 | B2 * | 11/2009 | Bhat et al. | 438/31 |
| 2007/0296335 | A1 | 12/2007 | Nihashi et al. | |
| 2010/0197069 | A1 | 8/2010 | Nihashi et al. | |
| 2011/0244665 | A1 * | 10/2011 | Mikami et al. | 438/478 |

FOREIGN PATENT DOCUMENTS

| | | |
|---|---|---|
| JP | 2000-021297 | 1/2000 |
| JP | 2001-319565 | 11/2001 |
| JP | 3623068 | 2/2005 |
| JP | 2007-165478 | 6/2007 |
| WO | WO 2005/088666 | 9/2005 |

* cited by examiner

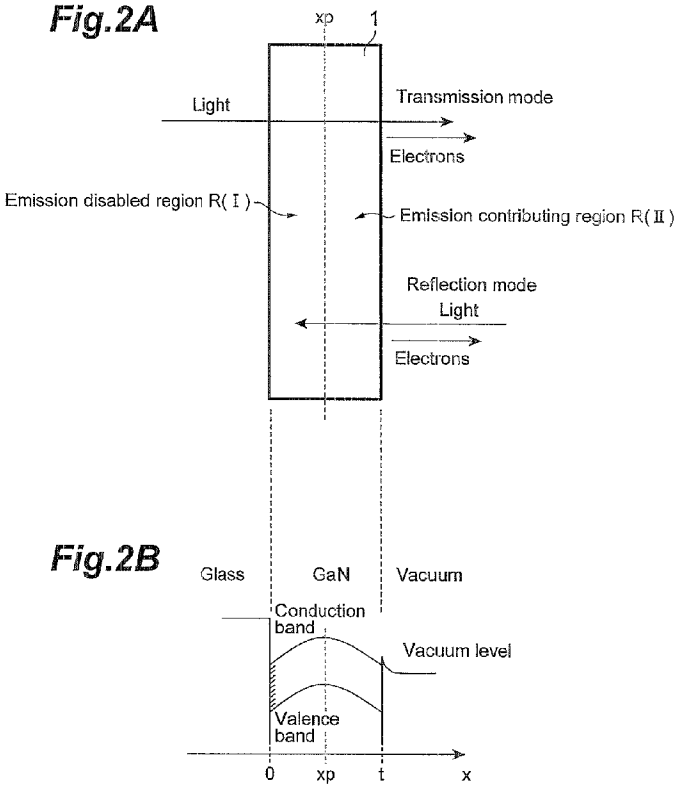
Fig.2A
Fig.2B
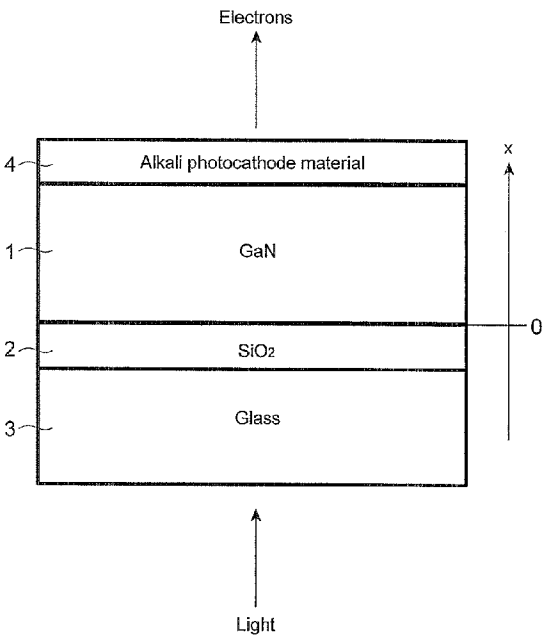
Fig.1

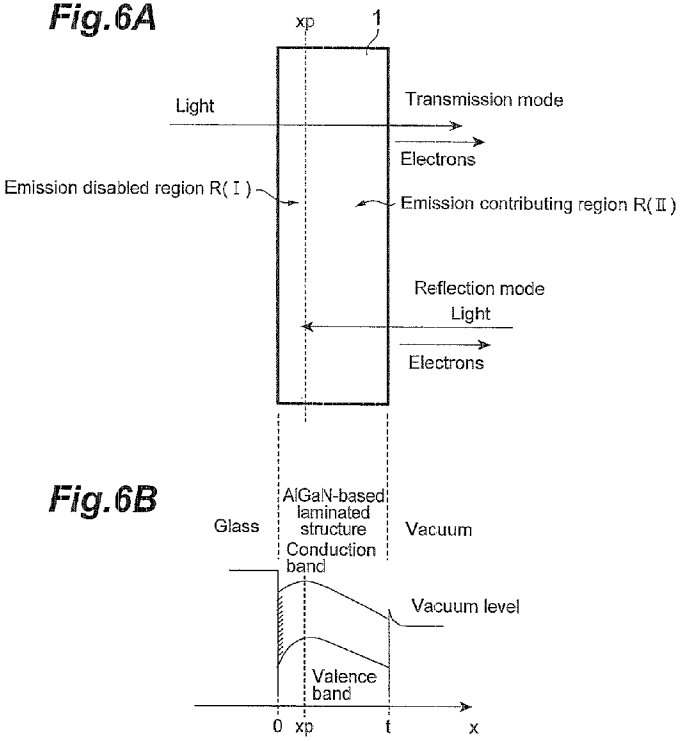
Fig.6A
Fig.6B
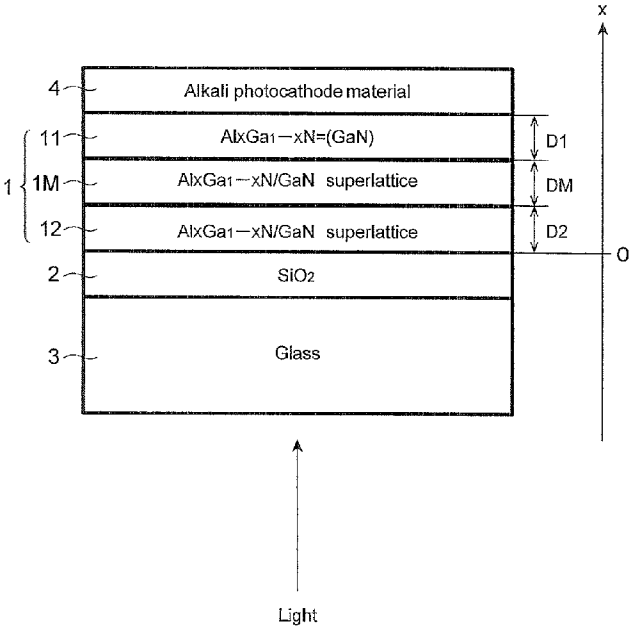
Fig.5

Fig.8B Type 1 (Comparative Example)

Fig.8C Type 2 (Example 1)

Fig.8D Type 3 (Example 2)

Fig.7B Type 1 (Comparative Example)

Fig.7C Type 2 (Example 1)

Fig.7D Type 3 (Example 2)

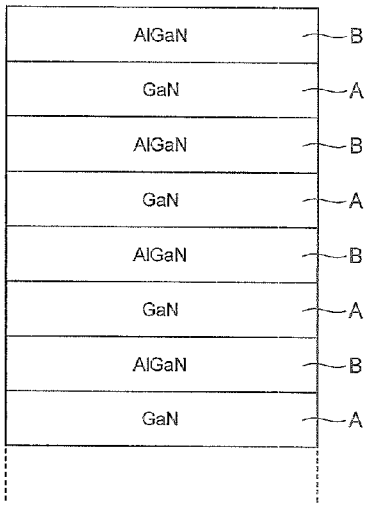
Fig.18
Fig.17
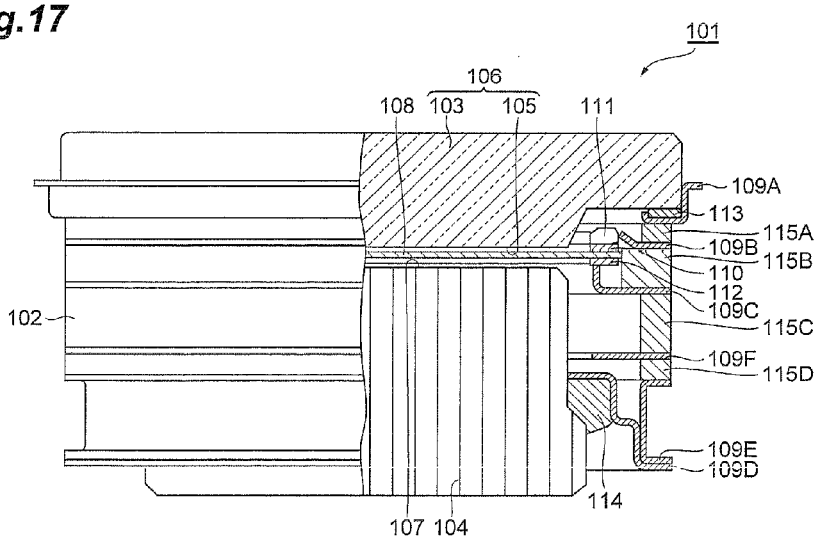

| | Region 12 ( X=Constant) | | Region 1M ( X=Graded) | | | Region 11 |
|---|---|---|---|---|---|---|
| | Thickness (nm) | Effective Al Composition Ratio X (%) | Thickness (nm) | Maximum Effective Al Composition Ratio X (%) | Minimum Effective Al Composition Ratio X (%) | Thickness (nm) |
| No.1 | 0 | 0 | 50 | 30 | 0 | 56 |
| No.2 | 25 | 40 | 25 | 40 | 0 | 55 |
| No.3 | 15 | 40 | 35 | 40 | 0 | 53 |
| No.4 | 10 | 40 | 40 | 30 | 0 | 48 |
| No.5 | 15 | 35 | 35 | 35 | 0 | 47 |
| No.6 | 25 | 30 | 25 | 30 | 0 | 42 |

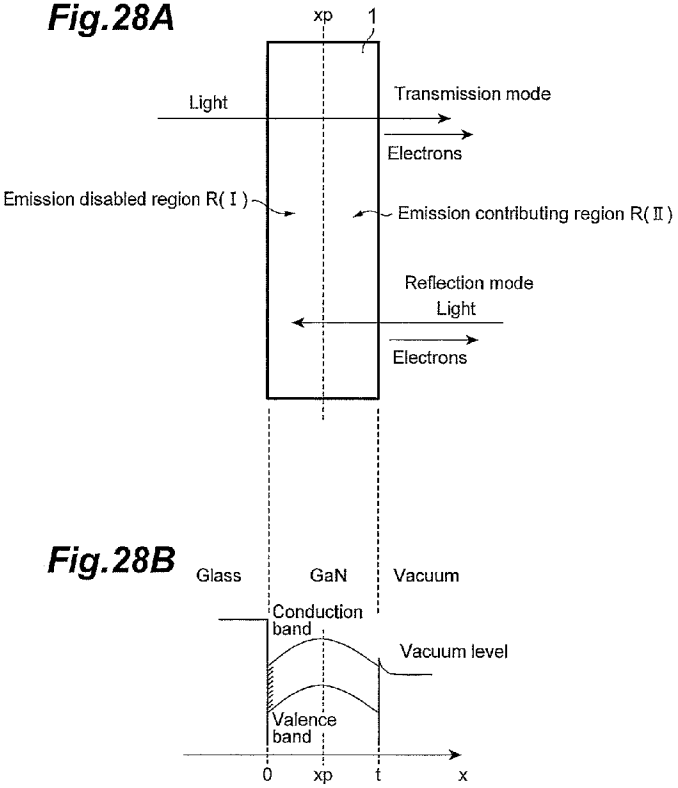
Fig.28A
Fig.28B
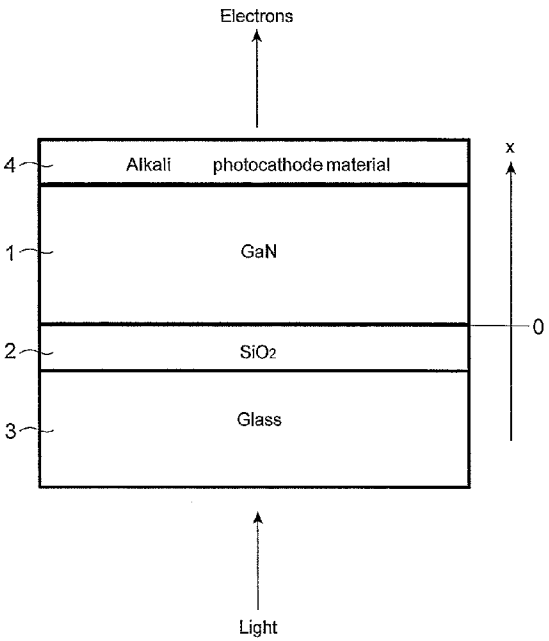
Fig.27

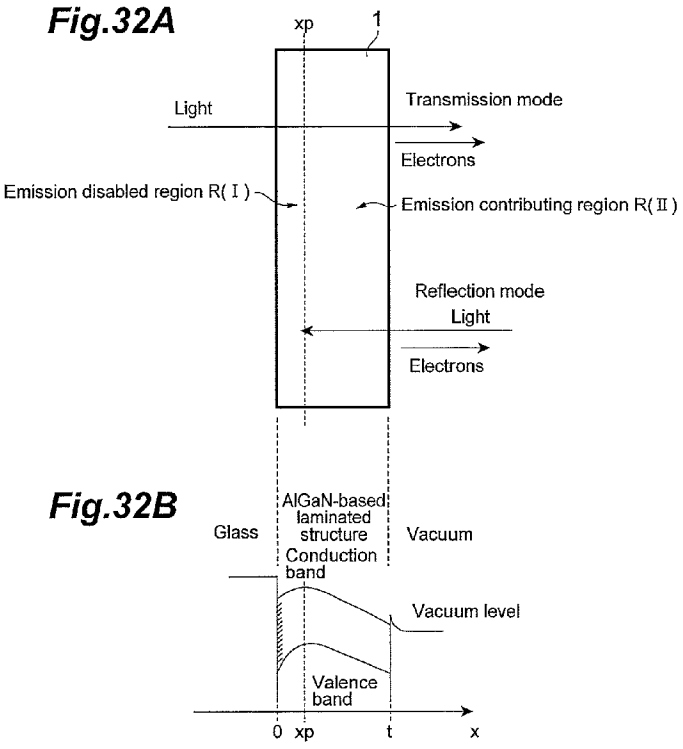
Fig.32A
Fig.32B
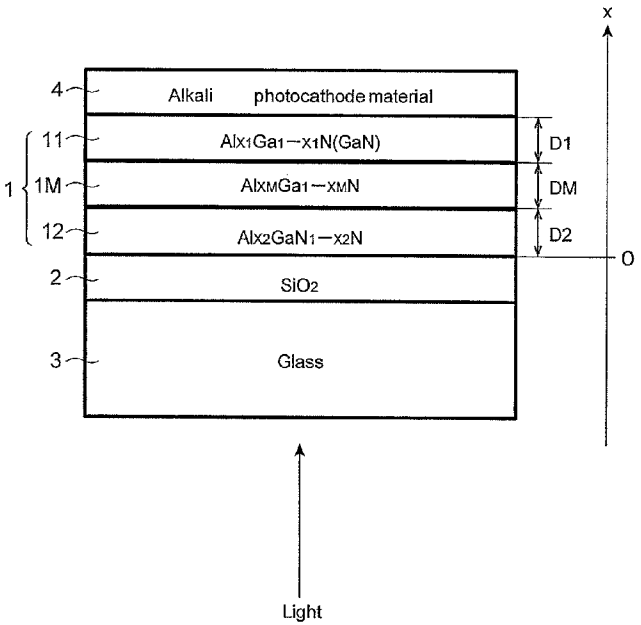
Fig.31

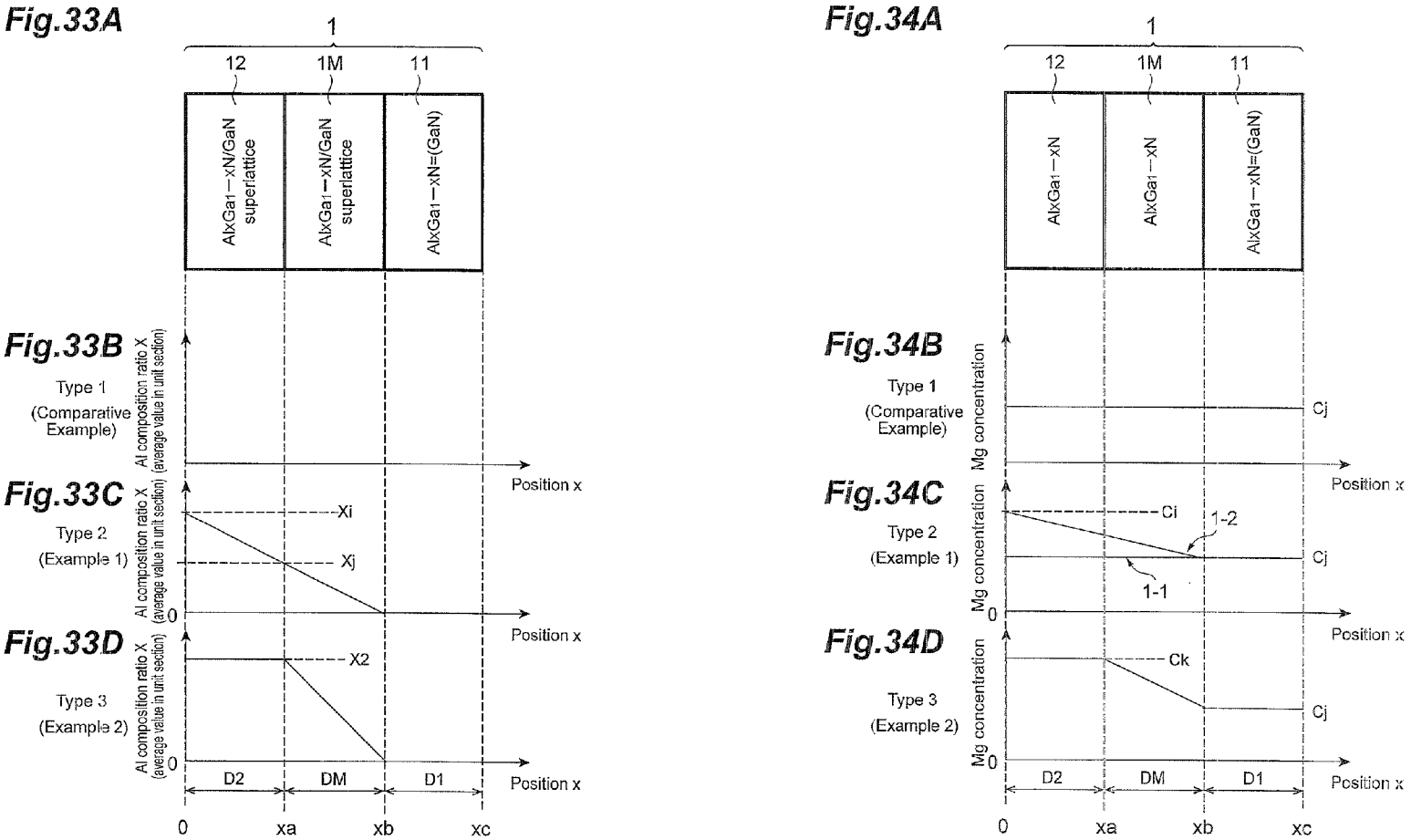
Fig.33A
1
12
1M
11
AlxGa1−xN/GaN superlattice
AlxGa1−xN/GaN superlattice
AlxGa1−xN=(GaN)
Fig.33B
Type 1 (Comparative Example)
Al composition ratio X (average value in unit section)
Position x
Fig.33C
Type 2 (Example 1)
Al composition ratio X (average value in unit section)
Xi
Xj
Position x
Fig.33D
Type 3 (Example 2)
Al composition ratio X (average value in unit section)
X2
Position x
0
xa
xb
xc
D2
DM
D1
Fig.34A
1
12
1M
11
AlxGa1−xN
AlxGa1−xN
AlxGa1−xN=(GaN)
Fig.34B
Type 1 (Comparative Example)
Mg concentration
Cj
Position x
Fig.34C
Type 2 (Example 1)
Mg concentration
Ci
1-2
1-1
Cj
Position x
Fig.34D
Type 3 (Example 2)
Mg concentration
Ck
Cj
Position x
0
xa
xb
xc
D2
DM
D1

*Fig.35A*
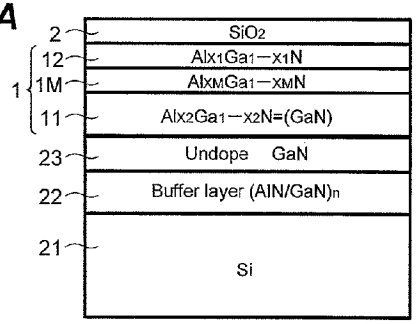
*Fig.35B*
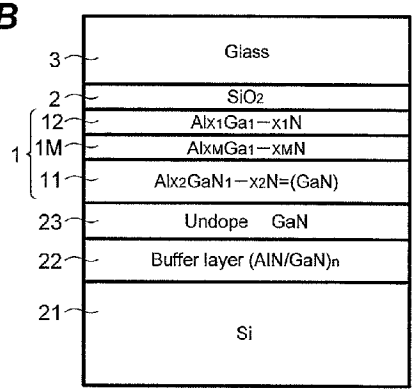
*Fig.35C*
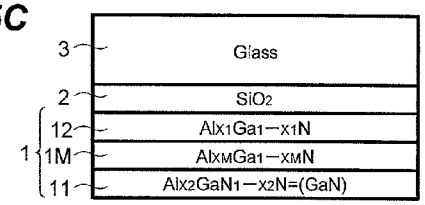
*Fig.36*
| | D= 68~78nm | D=81nm | D=96nm |
|---|---|---|---|
| Type 1 | No.(1-1)<br>D1=78nm | No.(1-2)<br>D1=81nm | No.(1-3)<br>D1=96nm |
| Type 2 | No.(2-1)<br>D1=18nm<br>DM=25nm<br>D2=25nm | No.(2-2)<br>D1=31nm<br>DM=25nm<br>D2=25nm | No.(2-3)<br>D1=46nm<br>DM=25nm<br>D2=25nm |
| Type 3 | No.(3-1)<br>D1=27nm<br>DM=25nm<br>D2=25nm | No.(3-2)<br>D1=31nm<br>DM=25nm<br>D2=25nm | No.(3-3)<br>D1=46nm<br>DM=25nm<br>D2=25nm |

*Fig.47*

| | |
|---|---|
| (1) $I = I_0 e^{-\alpha x}$ | (2) $\alpha = \frac{4\pi k}{\lambda}$ |
| (3) $n_A = I_0 \alpha e^{-\alpha x} \Delta x$ | (4) $n_S = n_A f$ |
| (5) $f_R(x) = e^{-\frac{x}{L}}$ | (6) $f_T(x) = e^{-\frac{t-x}{L}}$ |
| (7) $n_{SR} = I_0 \alpha e^{-\alpha x - \frac{x}{L}} \Delta x$ | (8) $n_{ST} = I_0 \alpha e^{-\alpha x - \frac{t-x}{L}} \Delta x$ |
| (9) $N_{SR} = I_0 \alpha \int_0^{x_P} e^{-\alpha x - \frac{x}{L}} dx$ | (10) $N_{ST} = I_0 \alpha \int_{x_P}^{t} e^{-\alpha x - \frac{t-x}{L}} dx$ |
| (11) $N_{SR} = I_0 \frac{\alpha}{\alpha + \frac{1}{L}} (1 - e^{-(\alpha + \frac{1}{L}) x_P})$ | (12) $N_{ST} = I_0 \frac{\alpha}{\alpha - \frac{1}{L}} e^{-\frac{t}{L}} (e^{-(\alpha - \frac{1}{L}) t} - e^{-(\alpha - \frac{1}{L}) x_P})$ |

SEMICONDUCTOR PHOTOCATHODE AND METHOD FOR MANUFACTURING THE SAME

BACKGROUND

1. Technical Field

Modes of the present invention relate to a semiconductor photocathode that emits electrons in response to incident light and a method for manufacturing the same.

2. Related Background Art

A conventionally known photocathode with a CsTe layer or a CsI layer can be used for detection of far-ultraviolet rays but is comparatively low in quantum efficiency and has strong wavelength dependence. In contrast, a photocathode using a compound semiconductor has potential for an improvement in these disadvantages.

Recent semiconductor photocathodes are described in Patent Document 1 and Patent Document 2. In Patent Document 1, a GaN layer is grown on a sapphire substrate to obtain a GaN layer of high quality. The GaN layer can be grown on a c-plane of the sapphire substrate. In both semiconductor photocathodes, a transparent substrate and a GaN layer are used and although both are capable of emitting electrons in response to incident light, sensitivities (quantum efficiencies) thereof are not sufficient. In the industrial field, demands for high precision detection of ultraviolet rays and especially detection of near-ultraviolet rays are increasing and an applicable semiconductor photocathode is being anticipated.

Near-ultraviolet rays are used in corona discharge observations, flame tests, biological agent tests, UV-LIDAR (laser imaging detection and ranging), UV Raman test apparatuses, semiconductor quality inspections, etc., and elucidation of new physical phenomena and improvements in various products can be anticipated if a highly sensitive compound semiconductor photocathode can be realized.

The above Patent Documents are as follows:

Patent Document 1: Japanese Patent No. 3623068

Patent Document 2: Japanese Patent Application Laid-Open No. 2007-165478

SUMMARY

However, findings by the present inventors have shown that the quantum efficiency of a photocathode obtained by bonding a GaN layer on a glass substrate is approximately 23% and a further improvement in the quantum efficiency is thus anticipated. On the other hand, with a semiconductor photocathode according to a mode of the present invention, the quantum efficiency can be improved in comparison to the conventional GaN photocathode.

The object of the device according to our embodiment is providing a semiconductor photocathode having higher quantum efficiency than that of the conventional GaN photocathode.

The present semiconductor photocathode comprises: an $Al_XGa_{1-X}N$ layer ($0 \le X < 1$) attached to a glass substrate via an $SiO_2$ layer; and an alkali metal-containing layer formed on the $Al_XGa_{1-X}N$ layer, wherein the $Al_XGa_{1-X}N$ layer includes: a first region adjacent to the alkali metal-containing layer; a second region adjacent to the $SiO_2$ layer; and an intermediate region located between the first region and the second region, wherein when a composition ratio is $X=g(x)$, where x represents a location of the $Al_XGa_{1-X}N$ layer in a direction of thickness from the second region to the alkali metal-containing layer and a location of interface between the second region and the $SiO_2$ layer is furnished as an origin point of the position x, and when $X_{MIN(M)}$ represents a minimum value for the composition ratio X in the intermediate region and $X_{MIN(2)}$ represents a minimum value for the composition ratio X in the second region, in the first region, $0 \le g(x) \le X_{MIN(M)}$ is satisfied, in the intermediate region, g(x) is a monotone decreasing function and $g(x) \le X_{MIN(2)}$ is satisfied, in the second region, g(x) is a monotone decreasing function or a constant value, in a case where g(x) in the second region is a monotone decreasing function, a thickness D1 of the first region is 18 (nm) or more, and in a case where g(x) in the second region is a constant value, a thickness D1 of the first region is 31 (nm) or more.

In the case when the Al composition ratio X and the thickness of the first region satisfy the above conditions, the quantum efficiency of the photocathode can greatly be higher than that of the conventional GaN photocathode.

The total thickness D of the $Al_XGa_{1-X}N$ layer, the thickness DM of the intermediate region, the thickness D2 of the second region, and an allowable error E satisfy the following relational expressions:

$$(D2+DM)\times(100\pm E)\%=D/2, \text{ and } E\le 60.$$

That is, in a case where the $Al_XGa_{1-X}N$ layer is uniform in composition, the peak of the energy level of the lower end of the conduction band is positioned near the position of one-half of the thickness D, and therefore by adjusting the energy level at the glass substrate side of the peak position xp by means of the intermediate region and the second region, electrons that cannot be emitted into vacuum can be transitioned to a higher energy level and an electron emission probability can thereby be increased in principle. Although it is considered that an increase in the electron emission efficiency can be obtained as long as the allowable error E is approximately in a range of no less than 60(%), obviously if $E \le 20$(%), it is considered that a further effect can be obtained.

AlGaN is a compound of Al (atomic number 13), Ga (atomic number 31) and N (atomic number 7). A lattice constant thereof decreases as the composition ratio of Al, which is smaller in atomic size than Ga, increases. In a compound semiconductor, there is a tendency for an energy band gap Eg to be greater when the lattice constant is smaller and thus as the composition ratio X increases, the energy band gap Eg increases and a corresponding wavelength $\lambda$ decreases.

Further, the minimum value $X_{MIN(2)}$ of the composition ratio X in the second region satisfies the following relational expression: $0.3 \le X_{MIN(2)} \le 0.65$. When the average value of the Al composition ratio X in the second region is no less than 0.3, the energy band gap Eg of the second region is large and the quantum efficiency is significantly improved because light of short wavelength (no more than 280 nm) is readily transmitted through the second region. Also, the Al composition ratio X cannot be increased beyond a limit in terms of manufacture and the average value of the composition ratio X is preferably no more than 0.65.

Preferably, the thickness D1 of the first region is 100 nm or less. In this case, the quantum efficiency can be increased.

The method for producing the semiconductor photocathode comprises: a step of sequentially depositing a GaN buffer layer, a GaN template layer, a compound semiconductor layer, and the $SiO_2$ layer on a support substrate; a step of attaching the glass substrate to the compound semiconductor layer via the $SiO_2$ layer; and a step of sequentially removing a part of the support substrate, the buffer layer, the template layer, and the compound semiconductor layer to convert a residual region of the compound semiconductor layer into the $Al_XGa_{1-X}N$ layer. In this case, the above semiconductor photocathode can be made easily.

A semiconductor photocathode according to one mode of the present invention includes an $Al_XGa_{1-X}N$ layer ($0 \leq X < 1$) bonded to a glass substrate via an $SiO_2$ layer and an alkali-metal-containing layer formed on the $Al_XGa_{1-X}N$ layer and is characterized in that the $Al_XGa_{1-X}N$ layer includes a first region adjacent to the alkali-metal-containing layer, a second region adjacent to the $SiO_2$ layer, and an intermediate region positioned between the first region and the second region, the second region has a semiconductor superlattice structure formed by laminating a barrier layer and a well layer alternately, the intermediate region has a semiconductor superlattice structure formed by laminating a barrier layer and a well layer alternately, and a region of a pair of adjacent barrier and well layers is defined as a unit section, an average value of a composition ratio X of Al in a unit section decreases monotonously with distance from an interface position between the second region and the $SiO_2$ layer at least in the intermediate region, the average value of the composition ratio X of Al in a unit section in the second region is no less than a maximum value of the average value of the composition ratio X of Al in a unit section in the intermediate region, and the average value of the composition ratio X of Al in the first region is no more than a minimum value of the average value of the composition ratio X of Al in a unit section in the intermediate region. With this photocathode, a quantum efficiency can be improved exceptionally in comparison to a conventional GaN photocathode.

According to one mode, the average value of the composition ratio X of Al in a unit section decreases monotonously with the distance from the interface position between the second region and the $SiO_2$ layer in the second region as well.

Also, according to another mode, the average value of the composition ratio X of Al in a unit section is fixed along a thickness direction in the second region.

Preferably, a total thickness D of the $Al_XGa_{1-X}N$ layer, a thickness DM of the intermediate region, a thickness D2 of the second region, and an allowable error E satisfy the following relational expressions: $(D2+DM)\times(100\pm E)\ \%=D/2$ and $E \leq 60$.

Preferably, a thickness D1 of the first region is no more than 100 nm.

AlGaN is a compound of Al (atomic number 13), Ga (atomic number 31) and N (atomic number 7) and a lattice constant thereof decreases as the composition ratio X of Al, which is smaller in atomic size than Ga, increases. In a compound semiconductor, there is a tendency for an energy band gap Eg to be greater when the lattice constant is smaller and therefore, as the composition ratio X increases, the energy band gap Eg increases and a corresponding wavelength $\lambda$ decreases.

The average value of the composition ratio X of Al in a unit section in the second region is no less than the average value in a unit section in the intermediate region, and therefore the energy band gap Eg of the second region increases and especially the energy band gap of the barrier layer making up the superlattice structure increases so that light of a short wavelength (no more than 280 nm) is readily transmitted through the second region and is transmitted to the intermediate region or the first region of high sensitivity. The quantum efficiency is thus significantly improved.

Also, there is a possibility for a carrier density to decrease when the Al composition ratio X is high. In order to suppress this, the semiconductor superlattice structure is adopted in the second region and the intermediate region and a resonance tunnel effect is made use of to suppress the decrease in density of transported carriers and enable the generated carriers to be transported at high efficiency to the first region. In the well layer in the semiconductor superlattice structure, the energy band gap is smaller than that in the barrier layer and therefore sensitivity to light of short wavelength is provided and a large number of carriers can be generated.

A method for manufacturing a semiconductor photocathode includes a step of successively depositing a GaN buffer layer, a GaN template layer, a compound semiconductor layer, and an $SiO_2$ layer on a supporting substrate, a step of bonding a glass substrate onto the compound semiconductor layer via the $SiO_2$ layer, and a step of successively removing the supporting substrate, the buffer layer, the template layer, and a portion of the compound semiconductor layer and making the remaining region of the compound semiconductor layer be an $Al_XGa_{1-X}N$ layer. The semiconductor photocathode described above can be manufactured readily by this manufacturing method.

Also, a semiconductor photocathode according to one mode of the present invention includes an $Al_XGa_{1-X}N$ layer ($0 \leq X < 1$) bonded to a glass substrate via an $SiO_2$ layer and an alkali-metal-containing layer formed on the $Al_XGa_{1-X}N$ layer and is characterized in that the $Al_XGa_{1-X}N$ layer includes a first region adjacent to the alkali-metal-containing layer, a second region adjacent to the $SiO_2$ layer, and an intermediate region positioned between the first region and the second region, the second region has a semiconductor superlattice structure formed by laminating a barrier layer and a well layer alternately, the intermediate region has a semiconductor superlattice structure formed by laminating a barrier layer and a well layer alternately, and when a region made up of a pair of adjacent barrier and well layers is defined as a unit section, an average value of a composition ratio X of Al in a unit section decreases with distance from an interface position between the second region and the $SiO_2$ layer at least in the intermediate region.

Also, an electron tube is characterized in including the semiconductor photocathode described above, an anode collecting electrons emitted from the semiconductor photocathode in response to incidence of light, and an enclosure housing an electron emission surface of the semiconductor photocathode and the anode inside a reduced-pressure environment.

Also, an image intensifier tube is characterized in including the semiconductor photocathode described above, a microchannel plate facing an electron emission surface of the semiconductor photocathode, a phosphor screen facing the microchannel plate, and an enclosure housing the electron emission surface of the semiconductor photocathode, the microchannel plate, and the phosphor screen inside a reduced-pressure environment.

Further, the present semiconductor photocathode comprises: an $Al_XGa_{1-X}N$ layer ($0 \leq X < 1$) bonded to a glass substrate via an $SiO_2$ layer; and an alkali-metal-containing layer formed on the $Al_XGa_{1-X}N$ layer; and wherein the $Al_XGa_{1-X}N$ layer includes a first region adjacent to the alkali-metal-containing layer, a second region adjacent to the $SiO_2$ layer, and an intermediate region positioned between the first region and the second region, wherein an effective Al composition ratio X(11) in the first region satisfy $0(\%) \leq X(11) \leq 30(\%)$, and a constant effective Al composition ratio X in the second region satisfy $15(\%) \leq X \leq X(11)+50(\%)$.

Further, the present semiconductor photocathode comprises: an $Al_XGa_{1-X}N$ layer ($0 \leq X < 1$) bonded to a glass substrate via an $SiO_2$ layer; and an alkali-metal-containing layer formed on the $Al_XGa_{1-X}N$ layer; and wherein the $Al_XGa_{1-X}N$ layer includes a first region adjacent to the alkali-metal-containing layer, a second region adjacent to the $SiO_2$ layer, and an intermediate region positioned between the first region and the second region, wherein an effective Al composition ratio X(11) in the first region satisfy 30(%)≤X(11)≤40(%), and a constant effective Al composition ratio X in the second region satisfy 60(%)≤X≤X(11)+50(%).

Further, the present semiconductor photocathode comprises: an $Al_XGa_{1-X}N$ layer (0≤X≤1) bonded to a glass substrate via an $SiO_2$ layer; and an alkali-metal-containing layer formed on the $Al_XGa_{1-X}N$ layer; and wherein the $Al_XGa_{1-X}N$ layer includes a first region adjacent to the alkali-metal-containing layer, a second region adjacent to the $SiO_2$ layer, and an intermediate region positioned between the first region and the second region, the second region has a semiconductor superlattice structure formed by laminating a barrier layer and a well layer alternately, the intermediate region has a semiconductor superlattice structure formed by laminating a barrier layer and a well layer alternately, and a region of a pair of adjacent barrier and well layers is defined as a unit section, an average value of a composition ratio X of Al in a unit section decreases monotonously with distance from an interface position between the second region and the $SiO_2$ layer at least in the intermediate region, the average value of the composition ratio X of Al in a unit section in the second region is no less than a maximum value of the average value of the composition ratio X of Al in a unit section in the intermediate region, and the average value of the composition ratio X of Al in the first region is no more than a minimum value of the average value of the composition ratio X of Al in a unit section in the intermediate region.

According to the present semiconductor photocathode, the quantum efficiency becomes higher than that of the conventional GaN photocathode, and it is easily produced by the present manufacturing method.

BRIEF DESCRIPTION OF THE DRAWINGS

FIG. 1 is a longitudinal sectional view of a semiconductor photocathode according to a comparative example (Type 1).

FIG. 2A is a sectional view and FIG. 2B is an energy band diagram of a compound semiconductor layer (GaN) according to the comparative example.

FIG. 5 is a longitudinal sectional view of a semiconductor photocathode according to an example (Type 2 or Type 3).

FIG. 6A is a sectional view and FIG. 6B is an energy band diagram of a compound semiconductor layer (AlGaN based laminar structure) according to each example.

FIG. 7A is a diagram of a compound semiconductor layer and FIG. 7B, FIG. 7C, and FIG. 7D are graphs of relationships of a position x in a thickness direction of the compound semiconductor layer and an Al composition ratio X.

FIG. 8A is a diagram of a compound semiconductor layer and FIG. 8B, FIG. 8C, and FIG. 8D are graphs of relationships of the position x in a thickness direction of the compound semiconductor layer and an impurity (Mg) concentration.

FIG. 17 is a partially broken-away front view of an image intensifier tube.

FIG. 18 is a diagram of a semiconductor superlattice structure.

FIG. 27 is a longitudinal cross sectional view of the photocathode of the comparative example (Type1).

FIG. 28A shows a cross sectional view of the compound semiconductor layer (GaN) of the comparative example and FIG. 28B show the energy band diagram of the layer.

FIG. 31 is a longitudinal sectional view of a semiconductor photocathode according to an example (Type 2 or Type 3).

FIG. 32A is a sectional view and FIG. 32B is an energy band diagram of a compound semiconductor layer (AlGaN based laminar structure) according to each example.

FIG. 33A is a diagram of a compound semiconductor layer and FIG. 33B, FIG. 33C, and FIG. 33D are graphs of relationships of a position x in a thickness direction of the compound semiconductor layer and an Al composition ratio X.

FIG. 34A is a diagram of a compound semiconductor layer and FIG. 34B, FIG. 34C, and FIG. 34D are graphs of relationships of the position x in a thickness direction of the compound semiconductor layer and an impurity (Mg) concentration.

FIG. 35A, FIG. 35B, and FIG. 35C are diagrams for explaining a method for manufacturing a semiconductor photocathode.

FIG. 36 is a diagram showing a list of conditions for samples of each type.

FIG. 47 is a table showing expressions.

DESCRIPTION OF THE PREFERRED EMBODIMENTS

Figure 4:
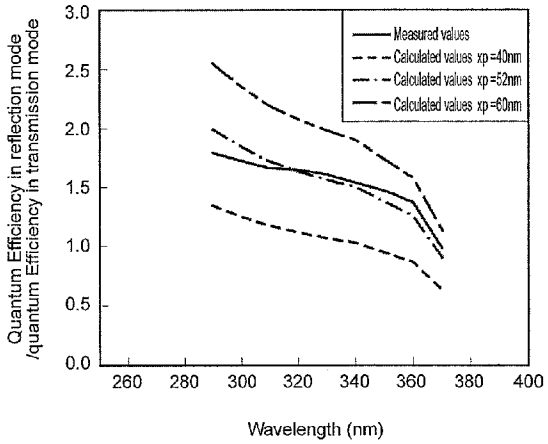
FIG. 4 is a graph of wavelength dependences of quantum efficiency in a reflection mode/quantum efficiency in a transmission mode for cases where a peak position xp of a lower end of the energy band is changed.

Semiconductor photocathodes according to embodiments shall now be described. The same symbols shall be used for elements that are identical to each other and redundant description shall be omitted.

First, a photocathode according to a comparative example (Type 1) shall be described.

FIG. 1 is a longitudinal sectional view of the semiconductor photocathode according to the comparative example (Type 1). The photocathode includes a compound semiconductor layer 1 made of GaN, an adhesive layer 2 made of $SiO_2$, a glass substrate 3, and an alkali-metal-containing layer 4 made of an alkali photocathode material. The compound semiconductor layer 1 is bonded to the glass substrate 3 via the adhesive layer 2, and after the bonding of the compound semiconductor layer 1 in a manufacturing process, the alkali photocathode material is deposited on an exposed surface of the compound semiconductor layer 1. Such a photocathode that is bonded to a glass substrate shall hereinafter be referred to as a glass bonded structure.

Silica, which makes up the glass substrate 3, is a "UV glass" that transmits ultraviolet rays and is made of borosilicate glass. As a borosilicate glass, for example, Kovar glass is known. Such a glass is made high in transmittance in a wavelength range of no less than approximately 185 nm wavelength, and "9741," made by Corning Inc., "8337B," made by Schott A G etc., may be used. Such a UV glass is higher than sapphire in ultraviolet transmittance at least at no less than 240 nm and is higher than sapphire in absorbance with respect to infrared rays with a wavelength of no less than 2 μm.

As the alkali photocathode material used in the alkali-metal-containing layer 4, Cs—I, Cs—Te, Sb—Cs, Sb—Rb—Cs, Sb—K—Cs, Sb—Na—K, Sb—Na—K—Cs, Ag—O—Cs, Cs—O, etc., are known. In the present example, Cs—O, which is an alkali oxide, is used as the alkali photocathode material. An alkali metal has a function of lowering a work function and imparting a negative electron affinity to facilitate emission of electrons into a vacuum level.

Here, an origin 0 of an x-axis is defined as an interface position between the compound semiconductor layer ($Al_XGa_{1-X}N$ (where X=0)) 1 and the adhesive layer ($SiO_2$ layer) 2 and x is defined as a position in a thickness direction of the compound semiconductor layer 1 from the interface toward the alkali-metal-containing layer 4. With the present semiconductor photocathode, light is made incident from the glass substrate 3 side, is transmitted through the adhesive layer 2, and arrives at the compound semiconductor layer 1. Photoelectric conversion is performed in the compound semiconductor layer 1 and electrons generated in correspondence to the incident light are emitted into vacuum via the alkali-metal-containing layer 4.

FIG. 2A is a sectional view and FIG. 2B is an energy band diagram of the compound semiconductor layer (GaN) 1 of the photocathode according to the comparative example.

Here, t is defined as a thickness with which a minute thickness of the alkali-metal-containing layer 4 is added to a total thickness D of the compound semiconductor layer 1. It is considered that, in the same manner as in a behavior of an energy band gap in a GaAs transmission type photocathode with a glass bonded structure or in a Si-based device, a defect level is formed at the heterojunction interface of the glass and the GaN crystal and, due to an electric field formed by carriers from this level, an energy band curve that decreases from the crystal toward the interface is formed. Meanwhile, a band curve that decreases toward the vacuum side is formed at a vacuum side surface of a p-type semiconductor. It is presumed that in the transmission type GaN photocathode, the effects of the two curves combine within a thin thickness of 100 nm to form a hill-shaped energy band.

In a transmission mode operation, an electron excited at a light incidence side of a peak of the hill of the band structure (an emission disabled region R(I) of $0<x<x_P$) cannot surpass the peak and move to a vacuum side slope and thus cannot be emitted into vacuum. In a case where the photocathode is put in a reflection mode operation, light is made incident from the vacuum side and electrons exit to the right side. The position of the peak of the band hill is thus important. Although in both operation modes, a region that functions effectively as a photocathode is a region at the vacuum side of the peak (an emission contributing region R(II) of $x_P<x<t$), in the transmission mode, much light is absorbed in a region at the light incidence side of the band peak and therefore an amount of light that enters the region at the right side, which practically operates as the photocathode, is considerably reduced. Oppositely, in the reflection mode, the region in which much light is absorbed contributes to photoelectron emission and high sensitivity is thus achieved.

To test this hypothesis, a quantum efficiency of the photocathode according to the comparative example (Type 1) was measured.

Figure 3:
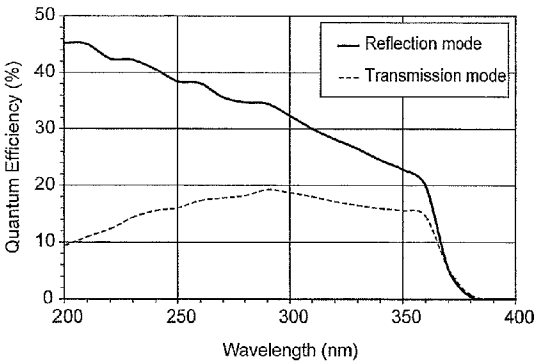
FIG. 3 is a graph showing relationships between wavelength (nm) and quantum efficiency (%).

FIG. 3 is a graph showing relationships between wavelength (nm) and the quantum efficiency (%) of the photocathode according to the comparative example.

Spectral sensitivities in the transmission mode and the reflection mode of the transmission type structure photocathode sealed in a photoelectric tube are shown in this figure. The photocathode has a thickness of 127 nm. Although the present inventors have thus far prepared a transmission type photocathode of the glass bonded structure and a transmission type photocathode using GaN grown on sapphire substrates, a maximum quantum efficiency that was obtained was no more than 25%. On the other hand, when a reflection type GaN photocathode with the glass bonded structure of Type 1 was sealed in a photoelectric tube and the sensitivity measured, whereas a high value of quantum efficiency of 35% was obtained at a wavelength of 280 nm, the quantum efficiency in the transmission mode was found to be lower than that in the reflection mode. This verifies that the energy band gap is curved as described above.

A position xp of the peak of the energy band gap bill is determined based on the above concepts. The quantum efficiencies of the reflection mode operation and the transmission mode operation can be estimated using the results of FIG. 3 and a complex refractive index of GaN. Light made incident on a substance is absorbed a little at a time at each location of passage and an intensity at a position of distance x from an incidence surface is in accordance with Lambert's law.

Theoretical quantum efficiencies of the reflection mode and the transmission mode can be determined using an electron diffusion length and an escape probability, and the values 235 nm and 0.5 have been determined respectively for the electron diffusion length and the escape probability in a report by Fuke et. al. (S. Fuke, M. Sumiya, T. Nihashi, M. Hagino, M. Matsumoto, Y. Kamo, M. Sato, K. Ohtsuka, "Development of UV-photocathode using GaN film on Si substrate," Proc. SPIE 6894, 68941F-1-68941F-7 (2008)). A calculated value of a ratio of the quantum efficiencies of the reflection mode and the transmission mode and an actual measurement value of the ratio of the quantum efficiencies can be compared.

With regard to the quantum efficiency during reflection, total numbers of electrons reaching the vacuum side interface ($N_{SR}$ (reflection type), $N_{ST}$ (transmission type)) can be calculated as follows.

(Reflection type)

$$N_{SR} = I_0 \frac{\alpha}{\alpha + \frac{1}{L}} (1 - e^{-(\alpha + \frac{1}{L})x_P})$$

(Transmission type)

$$N_{ST} = I_0 \frac{\alpha}{\alpha - \frac{1}{L}} e^{-\frac{1}{L}} (e^{-(\alpha + \frac{1}{L})t} - e^{-(\alpha - \frac{1}{L} x_P)})$$

In the above, $I_0$ is an incident intensity, a is an absorption coefficient, L is the electron diffusion length, t is a thickness of a portion of the photocathode excluding the glass substrate (portion corresponding to the compound semiconductor layer 1 and the alkali-metal-containing layer 4), and physical properties of the alkali metal layer 4 are approximated as being the same as those of the compound semiconductor layer 1.

In order to avoid influences of absorption of the glass surface plate on which the GaN crystal is bonded, a comparison is made in a range of no less than 290 nm. Results in cases where the diffusion length is set to 235 nm and the position xp of the band hill is set to 40 nm, 52 nm, and 60 nm from the surface were compared with actual measurement values. The results are shown in FIG. 4.

FIG. 4 is a graph of wavelength dependences of the (quantum efficiency in the reflection mode/quantum efficiency in a transmission mode) for cases where the peak position xp of the lower end of the energy band is changed. With regard to the position xp of the energy band hill, the actual measurement values and the calculated values were in the best agreement when xp=52 nm.

It thus became clear that the peak of the energy hill of the conduction band (lower end) is substantially at a center (position of D/2) (slightly closer to the glass junction interface) of the thickness (total thickness D) of the compound semiconductor layer 1. With a GaN photocathode with a thickness of approximately 100 nm, although half of the thickness of the photocathode does not contribute to photoelectron emission in both the reflection mode and the transmission mode, a larger amount of light is absorbed at the side at which light is made incident and this is a cause of the quantum efficiency being lower in the transmission mode than in the reflection mode.

That is, to improve the quantum efficiency, it is important to shift the peak position xp, which is positioned at substantially the center of the compound semiconductor layer 1, toward the glass substrate side. In semiconductor photocathodes according to examples, exceptionally high quantum efficiencies can be obtained by shifting the peak position xp toward the glass substrate side and further widening the energy band gap Eg at the glass substrate side.

FIG. 5 is a longitudinal sectional view of a semiconductor photocathode according to an example (Type 2 or Type 3). Differences with respect to the semiconductor photocathode of the comparative example (Type 1) are that the compound semiconductor layer 1 is made up of three regions 11, 1M, and 12 and Al is added to GaN so that semiconductor superlattice structures are formed in the two regions 1M and 12, and structures of other portions are the same as those of the comparative example.

The semiconductor photocathode according to each of the examples includes the compound semiconductor layer 1 ($Al_XGa_{1-X}N$ layer ($0 \leq X < 1$)) bonded to the glass substrate 3 via the adhesive layer 2 made up of the $SiO_2$ layer and the alkali-metal-containing layer 4 formed on the $Al_XGa_{1-X}N$ layer. The $Al_XGa_{1-X}N$ layer making up the compound semiconductor layer 1 includes a first region 11 adjacent to the alkali-metal-containing layer 4, a second region 12 adjacent to the adhesive layer 2 made up of the $SiO_2$ layer, and an intermediate region 1M positioned between the first region 11 and the second region 12.

FIG. 18 shows a semiconductor superlattice structure made up of well layers (GaN) A and barrier layers (AlGaN) B. Each of the intermediate region 1M and the second region 12 is made up of the semiconductor superlattice structure shown in FIG. 18. That is, the second region 12 has the semiconductor superlattice structure in which the well layers A and the barrier layers B are laminated alternately and the intermediate region 1M has the semiconductor superlattice structure in which the well layers A and the barrier layers B are laminated alternately. Each semiconductor superlattice structure may be made to have a thickness of 50 nm and have a superlattice structure made of ten pairs of AlN/GaN with each well layer A being made 2.5 nm in thickness and each barrier layer B being made 2.5 nm in thickness. The number of layers of the superlattice is not restricted to the above.

Here, a region made up of a pair of an adjacent barrier layer A and well layer B shall be defined as a unit section. In a case where the thickness t(A) of the well layer A and the thickness t(B) of the barrier layer B are equal, an average value of a composition ratio X of Al in a unit section is a value obtained by adding the composition ratio X(A) in the well layer A and the composition ratio X(B) in the barrier layer B and dividing the sum by 2. The average value in a unit section is $(t(A)\times X(A)+t(B)\times X(B))/(t(A)+t(B))$. Although it shall be deemed that the composition ratio X in each of the well layer and the barrier layer is fixed, in a case where there is fluctuation in each layer, the composition ratio of each layer shall be the average value in the layer.

Referring to FIG. 5, the average value of the Al composition ratio X in a unit section decreases monotonously with distance from an interface position between the second region 12 and the $SiO_2$ layer 2 at least in the intermediate region 1M. Also in Example 1, the average value of the Al composition ratio X in a unit section in the second region 12 is no less than a maximum value of the average value of the Al composition ratio X in a unit section in the intermediate region 1M. Also, in the first region 11, the average value of the Al composition ratio X is no more than a minimum value of the average value of the Al composition ratio X in a unit section in the intermediate region 1M.

Here, x is defined as a position in a thickness direction of the compound semiconductor layer 1 ($Al_XGa_{1-X}N$ layer) from the second region 12 toward the alkali-metal-containing layer 4 and an origin 0 of the position x is set at the interface position between the second region 12 and the adhesive layer 2 made of the $SiO_2$ layer. Here, if the average value $X_{AV}$ (the average value in the first region 11 or the average value in a unit section in the intermediate region 1M or the second region 12) of the Al composition ratio X is given as $X_{AV}=g(x)$ (which, in a case of a discrete function using the average values in a unit sections, is a continuous function passing through the values and approximating the discrete function), the following conditions (1) to (3) are satisfied with $X_{MIN(M)}$ being the minimum value of the average value of the composition ratio X in a unit section in the intermediate region 1M and $X_{MIN(2)}$ being the minimum value of the average value of the composition ratio X in a unit section in the second region 12.

(1): In the first region 11, $0\leq g(x)\leq X_{MIN(M)}$ is satisfied.

(2): In the intermediate region 1M, g(x) is a monotonously decreasing function and satisfies $g(x)\leq X_{MIN(2)}$.

(3): In the second region 12, g(x) is a monotonously decreasing function (Example 1) or is a fixed value (Example 2).

Preferably, (4) in a case where g(x) in the second region 12 is a monotonously decreasing function, a thickness D1 of the first region is no less than 18 (nm), and (5) in a case where g(x) in the second region 12 is a fixed value, the thickness D1 of the first region 11 is no less than 31 (nm).

In a case where the Al composition ratio X and the thickness D1 of the first region satisfy the above conditions, the quantum efficiency can be improved exceptionally compared to the conventional GaN photocathode.

Although the Al composition ratio X of the first region 11 and the composition ratio X of the well layer in the semiconductor superlattice structure are preferably 0 and these regions are preferably made of GaN, these regions may contain a low concentration of Al.

With the examples, two types of photocathodes are prepared. The semiconductor photocathode of Type 2 satisfies the condition (4) and the photocathode of Type 3 satisfies the condition (5). In the case where the Al composition ratio X decreases monotonously, the maximum value and the minimum value are respectively defined at the two interface positions of the corresponding semiconductor layer and although in principle, the composition ratio changes at a fixed slope between the two positions, in an actual product, the composition ratio X does not necessarily change always at a fixed proportion with respect to a change of position in the thickness direction due to inclusion of manufacturing error.

FIG. 6A is a sectional view and FIG. 6B is an energy band diagram of the compound semiconductor layer (AlGaN based laminar structure) according to each example. In comparison to the semiconductor photocathode of the comparative example, the peak position xp of the energy level of the lower end of the conduction band is shifted more toward the glass substrate side than a central position in the thickness direction of the compound semiconductor layer 1. This is due to making the Al composition ratio X higher at the glass substrate side than at the central position and the electron emission disabled region R(I) is thereby decreased and the emission contributing region R(II) is increased. At a vicinity of the glass substrate, the average value of the Al composition ratio X in a unit section is no less than 0.3 and transmittance of light of short wavelength (wavelength: 280 nm) in this disabled region is thereby increased so that an amount of light that is photoelectrically converted at the emission contributing region is increased.

D is the total thickness of the compound semiconductor layer 1 ($Al_XGa_{1-X}N$ layer), D1 is the thickness of the first region, DM is a thickness of the intermediate layer, D2 is a thickness of the second region 12, and E is an allowable error. As described above, to dramatically improve the quantum efficiency, it is important to adjust the energy band gap of the region positioned more to the glass substrate side than the central position (D/2).

That is, the semiconductor photocathodes of the examples satisfy the following relational expressions:

$$(D2+DM)\times(100\pm E)\%=D/2,$$

$$E\leq 60$$

In a case where the compound semiconductor layer 1 is uniform in composition, the peak of the energy level of the lower end of the conduction band is positioned near the position of one-half of the thickness D, and therefore by adjusting the energy level at the glass substrate side of the peak position xp by means of the intermediate region 1M and the second region 12, electrons that cannot be emitted into vacuum can be transitioned to a higher energy level and an electron emission probability can thereby be increased in principle. Although it is considered that an increase in the electron emission efficiency can be obtained as long as the allowable error E is approximately in a range of no less than 60(%), obviously if $E\leq 20(\%)$, it is considered that a further effect can be obtained, and if $E\leq 10(\%)$, it is considered that an even further effect can be obtained.

AlGaN is a compound of Al (atomic number 13), Ga (atomic number 31) and N (atomic number 7). A lattice constant thereof decreases as the composition ratio of Al, which is smaller in atomic size than Ga, increases. In a compound semiconductor, there is a tendency for an energy band gap Eg to be greater when the lattice constant is smaller and thus as the composition ratio X increases, the energy band gap Eg increases and a corresponding wavelength λ decreases.

The minimum value $X_{MIN(2)}$ of the average value of the composition ratio X in a unit section in the second region 12 satisfies the following relationship.

$$0.15 \leq X_{MIN(2)} \leq 0.4$$

When the average value of the Al composition ratio X in a unit section in the second region 12 is no less than 0.15, the energy band gap Eg of the second region 12 is large and the quantum efficiency is significantly improved especially at the glass substrate side because light of short wavelength (no more than 280 nm) is readily transmitted through the second region 12. Also, the Al composition ratio X cannot be increased beyond a limit (X=0.8) in terms of manufacture and the average value of the composition ratio X in a unit section is preferably no more than 0.4. This is because crystallinity is significantly degraded when the Al composition ratio X exceeds the upper limit.

Also, the thickness D1 of the first region 11 is preferably no more than 100 nm. In this case, the quantum efficiency can be increased. The thickness of a general GaN photocathode is approximately 100 nm and it is thus considered that sufficient photoelectric conversion will be performed and electron emission will be performed if at least D1 is no more than 100 nm. Also, the thickness D1 is preferably no more than 235 nm because electron emission into vacuum decreases significantly when the electron diffusion length of 235 nm is exceeded. As described above, if D1 (117.5 nm) is one-half of the total thickness D and the allowable error is 60%, the total thickness D is substantially no more than 235 nm, and in a case where an allowable limit is DM+D2=47 (=117.5×0.4) nm, it is necessary for D1=188 (=235−47) nm or less. Similarly, if the allowable error is 20%, it is necessary for D1=141 (=235−117.5×0.8) nm or less. As mentioned above, the thickness D1 is preferably no more than 235 nm, more preferably no more than 188 nm, yet more preferably no more than 141 nm, and optimally no more than 100 mm.

Figure 7A:
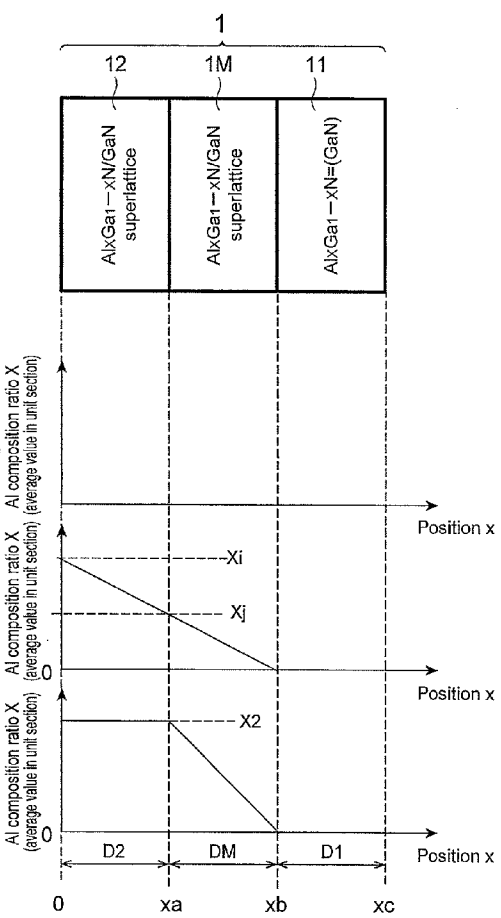

FIG. 7A to FIG. 7D shows, together with the compound semiconductor layer, graphs of relationships of the position x in the thickness direction of the compound semiconductor layer 1 and the Al composition ratio X according to type. FIG. 7A is a diagram of a compound semiconductor layer and FIG. 7B, FIG. 7C, and FIG. 7D are graphs of relationships of a position x in a thickness direction of the compound semiconductor layer and an Al composition ratio X.

With the semiconductor photocathode of Type 1 (comparative example), the Al composition ratio X is zero in all regions 11, 1M, and 12.

With the semiconductor photocathode of Type 2 (Example 1), the Al composition ratio X in the first region 11 (positions xb to xc) is zero. A function connecting the Al composition ratios X (average values in the unit sections) in the intermediate region 1M (positions xa to xb) decreases monotonously with respect to the position x (a slope of change of X with respect to x is (−a)). a is a fixed value. A function connecting the Al composition ratios X (average values in the unit sections) in the second region 12 (positions 0 to xa) decreases monotonously with respect to the position x (a slope of change of X with respect to x is (−a)). a is a fixed value.

In the second region 12, the maximum value of the composition ratio X (average value in a unit section) is Xi and the minimum value is Xj, and in the intermediate region 1M, the maximum value of the composition ratio X (average value in a unit section) is Xj and the minimum value is 0. The maximum values and the minimum values are obtained at the positions of the opposite interfaces of the respective layers. With Type 2, among the present examples, Xi and Xj are set as Xi=0.3 and Xj=0.5.

With the semiconductor photocathode of Type 3 (Example 2), the Al composition ratio X in the first region 11 (positions xb to xc) is zero. The Al composition ratio X (average values in the unit sections) in the intermediate region 1M (positions xa to xb) decreases monotonously with respect to the position x (a slope of change of X with respect to x is (−2×a)). a is a fixed value. The Al composition ratio X (average value in a unit section) in the second region 12 is independent of the position x and is of a fixed value (X2). In the second region 12, the maximum value or minimum value X2 of the composition ratio X (average value in a unit section) is the maximum value X2 of the composition ratio X (average values in the unit sections) in the intermediate region 1M. With Type 3, among the present examples, X2 is set as X2=0.3.

Figure 8A:
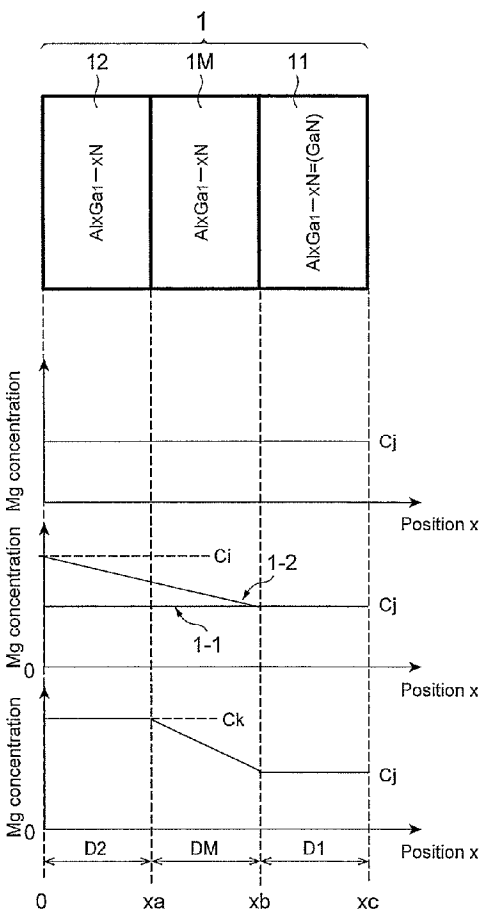

FIG. 8A to FIG. 8D shows, together with the compound semiconductor layer, graphs of relationships of the position x in the thickness direction of the compound semiconductor layer and an impurity (Mg) concentration according to type. FIG. 8A is a diagram of a compound semiconductor layer and FIG. 8B, FIG. 8C, and FIG. 8D are graphs of relationships of the position x in a thickness direction of the compound semiconductor layer and an impurity (Mg) concentration.

With the semiconductor photocathode of Type 1 (comparative example), the Mg concentration is fixed (=Cj) in all regions 11, 1M, and 12.

With the semiconductor photocathode of Type 2 (Example 1), the Mg concentration is fixed (=Cj) in the first region 11 (Example 1-1). However, the Mg concentration may be increased toward the glass substrate side to a concentration Ci in accordance with the increase in the Al composition ratio X toward the glass substrate side (Example 1-2). In other words, a p-type impurity concentration C is proportional to the function g(x), which is a monotonously decreasing function with respect to the position x. By changing the impurity concentration in the same manner as the change of composition ratio, an effect of compensation of a decrease in carrier concentration due to an increase in Al composition is anticipated.

With the semiconductor photocathode of Type 3 (Example 2), the Mg concentration is fixed (=Cj) in the first region 11. The Mg concentration is increased toward the glass substrate side to a concentration Ck in accordance with the increase in the Al composition ratio X toward the glass substrate side. In other words, the p-type impurity concentration C is of a fixed value in the second region 12 and is proportional to the function g(x), which is a monotonously decreasing function with respect to the position x, in the intermediate region 1M. By changing the impurity concentration in the same manner as the change of composition ratio, the effect of compensation of a decrease in carrier concentration due to an increase in Al composition is anticipated. The values of the impurity concentrations Cj, Ci, and Ck are respectively as follows.

$$Cj=7\times10^{18}\ \mathrm{cm}^{-3}$$

$$Ci=2\times10^{18}\ \mathrm{cm}^{-3}$$

$$Ck=2\times10^{18}\ \mathrm{cm}^{-3}$$

Also from standpoints of realizing a negative electron affinity (NEA) and lowering of crystallinity due to excessive doping, preferable ranges of the impurity concentrations Cj, Ci, and Ck are respectively as follows.

$$Cj=1\times10^{18}\ \mathrm{cm}^{-3}\text{ or more, }3\times10^{19}\ \mathrm{cm}^{-3}\text{ or less}$$

$$Ci=3\times10^{18}\ \mathrm{cm}^{-3}\text{ or more, }5\times10^{19}\ \mathrm{cm}^{-3}\text{ or less}$$

$$Ck=3\times10^{18}\ \mathrm{cm}^{-3}\text{ or more, }5\times10^{19}\ \mathrm{cm}^{-3}\text{ or less}$$

Figure 9A:
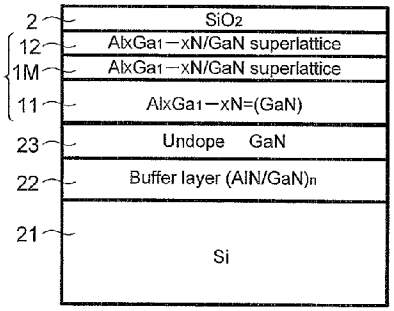
FIG. 9A, FIG. 9B, and FIG. 9C are diagrams for explaining a method for manufacturing a semiconductor photocathode.
Figure 9B:
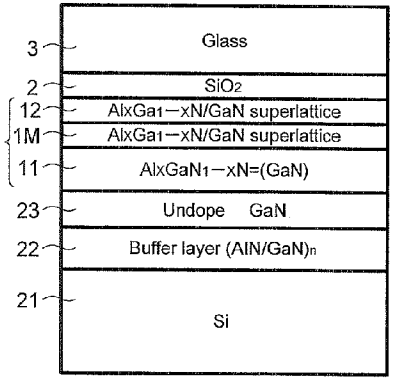
Figure 9C:
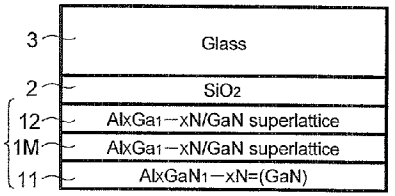

FIG. 9A to FIG. 9C show diagrams for explaining a method for manufacturing a semiconductor photocathode.

First, an AlGaN crystal before bonding is manufactured on an Si substrate (FIG. 9A), the Si substrate and unnecessary semiconductor layers are then removed by polishing to prepare a compound semiconductor layer 1, and lastly, the compound semiconductor layer 1 is bonded to a glass substrate 3 (FIG. 9B) and a portion is removed (FIG. 9C). This process shall now be described in detail.

First, as shown in FIG. 9A, a 5-inch n-type (111) Si substrate is prepared. Although the compound semiconductor layer 1 with Mg added is then grown on the Si substrate by an MOVPE (metal-organic vapor phase epitaxy) method, before growing the compound semiconductor layer 1, a buffer layer 22 for stress relaxation and an undoped GaN layer (template layer) 23 are successively grown on the Si substrate 21 in advance. The buffer layer 22 is 1200 nm in thickness and has a superlattice structure made of 40 pairs of AlN/GaN, and the undoped template layer 23 has a thickness of 650 nm. The compound semiconductor layer 1 ($Al_XGa_{1-X}N$) that is free of cracks and stress can thereby be formed on the Si substrate 21.

In the MOVPE method, trimethylgallium (TMGa) may be used as a raw material of Ga, trimethylaluminum (TMA) may be used as a raw material of Al, ammonia ($NH_3$) may be used as a raw material of N, and by controlling the ratio of these raw materials, the composition ratio X in $Al_XGa_{1-X}N$ can be adjusted. Hydrogen gas is used as a carrier gas. A growth temperature of the buffer layer 22 with the AlN/GaN superlattice structure and the GaN template layer 23 is 1050° C. A pressure inside a chamber during growth of the buffer layer 22 is $1.3\times10^3$ Pa and the pressure inside the chamber during growth of the template layer 23 is $1.3\times10^3$ to $1.0\times10^5$ Pa. In a region of 200 nm from a surface of the compound semiconductor layer 1 before removal by etching, Mg is added using ($Cp_2Mg$: bis(cyclopentadienyl)magnesium).

Also, with regard to manufacture of the buffer layer 22, a substrate temperature is set to 1120° C. and thereafter a flow rate of a TMA gas, in other words, a supply rate of Al is set to approximately 63 μmol/minute and a flow rate of an $NH_3$ gas, in other words, a supply rate of $NH_3$ is set to approximately 0.14 mol/minute to form the AlN layer, and then after stopping the supply of the TMA gas with the substrate temperature being set to 1120° C., a TMG gas and the $NH_3$ gas are supplied into the reaction chamber to form a second layer made of GaN on an upper surface of a first layer made of AlN that is formed on one principal surface of the substrate 21.

In forming the template layer 23, the TMG gas and the $NH_3$ gas are supplied into the reaction chamber to form GaN on an upper surface of the buffer layer 22. After setting the substrate temperature to 1050° C., a flow rate of the TMG gas, in other words, a supply rate of Ga is set to approximately 4.3 μmol/minute and the flow rate of the $NH_3$ gas, in other words, the supply rate of $NH_3$ is set to approximately 53.6 mmol/minute.

The substrate temperature is set to 1050° C., the TMG gas, ammonia gas, and $Cp_2Mg$ gas are supplied into the reaction chamber or, the TMA gas is supplied as the Al raw material to form a p-type GaN layer or a p-type AlGaN layer on the template layer 23. The flow rate of the TMG gas is set to approximately 4.3 μmol/minute and the flow rate of the TMA gas is adjusted in accordance with a change of the Al composition. For example, if the composition ratio X is to be set to 0.30, the flow rate of the TMA gas is approximately 0.41 μmol/minute. The flow rate of the $Cp_2Mg$ gas is set to approximately 0.24 μmol/minute when the Al composition is to be 0.3 and to approximately 0.12 μmol/minute when the Al composition is to be 0. The p-type impurity concentration in the compound semiconductor layer 1 is approximately 0.1 to $3\times10^{18}$ $cm^{-3}$. With the above manufacturing method, crystal orientations of the respective layers 23 and 1 can be aligned with the crystal orientation of the buffer layer 22. Methods for forming the superlattice structures in the second region 12 and the intermediate region 1M are the same as that in the case of the buffer layer 22, and in order to form AlGaN in place of AlN, TMGa is supplied in addition to TMA and $NH_3$ as the raw material gases together with the impurity gas.

In the structure of the comparative example (Type 1), an initial thickness of the compound semiconductor layer 1 is 200 nm, in the structure of Example 1 (Type 2), a region up to 50 nm from the surface is a graded AlGaN with the semiconductor superlattice structure in which the average value of the Al composition in a unit section changes gradually, and in the structure of Example 2 (Type 3), a region up to 25 nm from the surface is AlGaN with the average value of the Al composition in a unit section being fixed and a region from 25 nm to 50 nm from the surface is a graded AlGaN layer with the semiconductor superlattice structure in which the average value of the Al composition in a unit section changes gradually. Although the initial thickness of the compound semiconductor layer 1 is 200 nm, a region corresponding to substantially half of the total thickness is removed by etching.

On an exposed surface of the compound semiconductor layer 1 after growth, the adhesive layer 2, made of $SiO_2$ and having a thickness of several hundred nm, is formed by a CVD (chemical vapor deposition) method.

Thereafter as shown in FIG. 9B, the glass substrate 3 is bonded by thermocompression bonding via the adhesive layer 2 onto the compound semiconductor layer 1. A temperature during the compression bonding is 650° C.

Thereafter as shown in FIG. 9C, the Si substrate 21 is removed and subsequently, the buffer layer 22, the template layer 23, and a portion of the compound semiconductor layer 1 are removed. The Si substrate 21 is removed using a mixed liquid of hydrofluoric acid, nitric acid, and acetic acid. In this process, the buffer layer 22 also functions as an etching stopping layer. The buffer layer 22, the template layer 23, and a region of half of the thickness (100 nm) of the compound semiconductor layer 1 are removed by a mixed liquid of phosphoric acid and water. The compound semiconductor layer 1 is thereby made approximately 100 nm in thickness. In the present example, the total thickness D can be changed by changing the amount removed from the compound semiconductor layer.

As described above, the above method for manufacturing the semiconductor photocathode includes the step of successively depositing the GaN buffer layer 22, the GaN template layer 23, the compound semiconductor layer 1, and the $SiO_2$ layer 2 on the supporting substrate 21, the step of bonding the glass substrate 3 onto the compound semiconductor layer 1 via the $SiO_2$ layer 2, and a step of successively removing the supporting substrate 21, the buffer layer 22, the template layer 23, and a portion of the compound semiconductor layer 1 and making the remaining region of the compound semiconductor layer 1 be the $Al_XGa_{1-X}N$ layer (11, 1M, and 12). With this manufacturing method, the semiconductor photocathode described above can be manufactured readily.

A specific Al composition of Example 1 is as follows.

Figure 10:
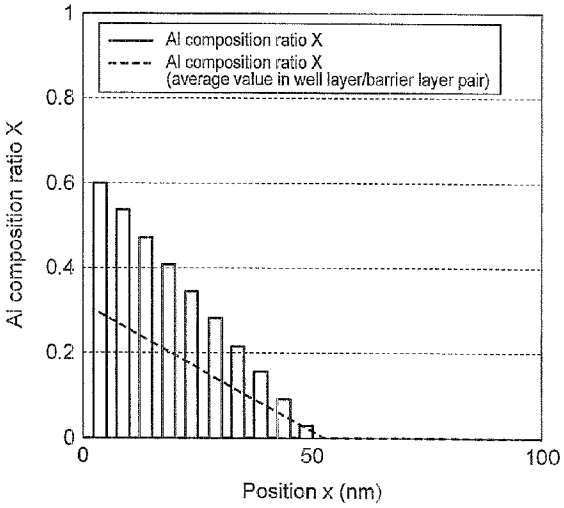
FIG. 10 is a graph showing a relationship between the position x (nm) and the Al composition ratio X.

FIG. 10 is a graph showing a relationship between the position x (nm) and the Al composition ratio X in Example 1. The total thickness of the compound semiconductor layer 1 is 100 nm. As the position x increases, the Al composition ratio X changes in a pulsed form and the average value in a unit section (average value in a well layer/barrier layer pair (defined as the composition at a boundary position)) decreases. The thickness of the second region 12 is 25 nm, the thickness of the intermediate region 1M is 25 nm, and the thickness of the first region 11 is 50 nm. Although the thickness of the first region 11 in the initial stage of manufacture is 150 nm, the region is etched to 50 nm in the etching step described above. In the second region 12, although the maximum value of the composition ratio X is 0.6 and the minimum value is 0, the maximum value of the average value in a unit section is approximately 0.3 and the minimum value is approximately 0.15. Also in the intermediate region 1M, the maximum value of the composition ratio X is approximately 0.3 and the minimum value is 0.

Figure 11:
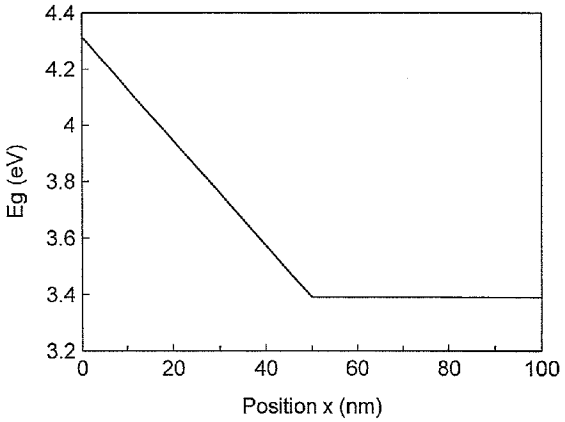
FIG. 11 is a graph showing a relationship between the position x (nm) and Eg (eV).

FIG. 11 is a graph showing a relationship between the position x (nm) and the energy band gap Eg (eV). Here, in the second region and the intermediate region, the average value of the energy band gap Eg (eV) in a unit section is indicated, and the energy band gap Eg corresponds to the Al composition ratio X. At the glass substrate side, Eg=4.3 (eV), and at the interface (x=50 nm) of the first region 11 and the intermediate region 1M, the energy band gap is 3.4 (eV).

Figure 12:
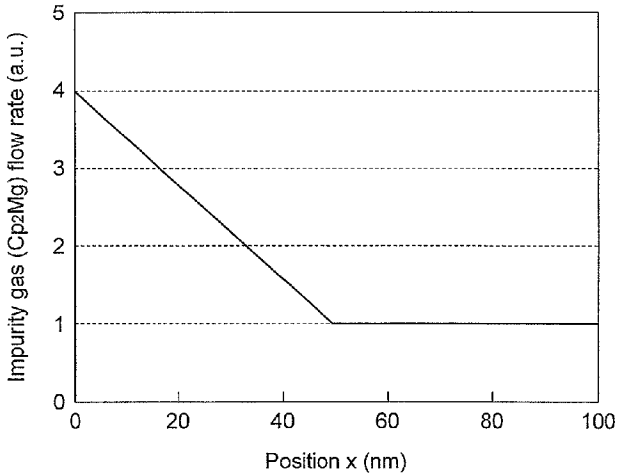
FIG. 12 is a graph showing a relationship between the position x (nm) and an impurity gas flow rate (a. u.).

FIG. 12 is a graph showing a relationship between the position x (nm) and the impurity gas flow rate (a. u.). Up to x=50 nm, the amount of the impurity gas gradually decreases as the position x increases. The region for which x=50 nm or more is the first region 11 and the amount of the impurity gas takes on a fixed value. If the added amount (gas flow rate) of Mg in the first region 11 is set as 1, the maximum value of the added amount (gas flow rate) of Mg in the second region is four times thereof.

A specific Al composition of Example 2 is as follows.

Figure 13:
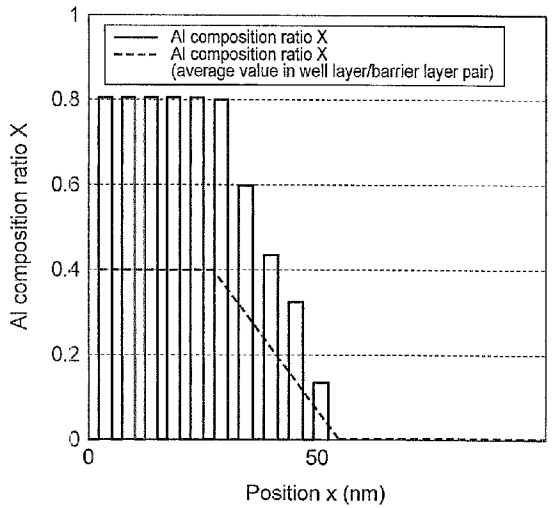
FIG. 13 is a graph showing a relationship between the position x (nm) and the Al composition ratio X.

FIG. 13 is a graph showing a relationship between the position x (nm) and the Al composition ratio X in Example 2. The total thickness of the compound semiconductor layer 1 is 100 nm. As the position x increases, the Al composition ratio X changes in a pulsed form and the average value in a unit section (average value in a well layer/barrier layer pair (defined as the composition at a boundary position)) takes on a fixed value in the second region 12 and decreases with the position x in the intermediate region 1M. The thickness of the second region 12 is 25 nm, the thickness of the intermediate region 1M is 25 nm, and the thickness of the first region 11 is 50 nm. Although the thickness of the first region 11 in the initial stage of manufacture is 150 nm, the region is etched to 50 nm in the etching step described above. In the second region 12, although the maximum value of the composition ratio X is 0.8 and the minimum value is 0, the average value in a unit section takes on the fixed value of 0.4. Also in the intermediate region 1M, the maximum value of the composition ratio X is approximately 0.4 and the minimum value is 0.

Figure 14:
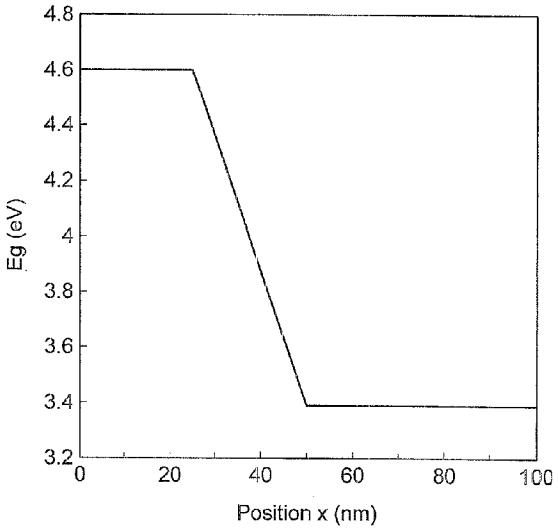
FIG. 14 is a graph showing a relationship between the position x (nm) and the Eg (eV).

FIG. 14 is a graph showing a relationship between the position x (nm) and the energy band gap Eg (eV). Here, in the second region and the intermediate region, the average value of the energy band gap Eg (eV) in a unit section is indicated, and the energy band gap Eg corresponds to the Al composition ratio X. At the glass substrate side, Eg=4.6 (eV), and at the interface (x=50 nm) of the first region 11 and the intermediate region 1M, the energy band gap is 3.4 (eV).

Figure 15:
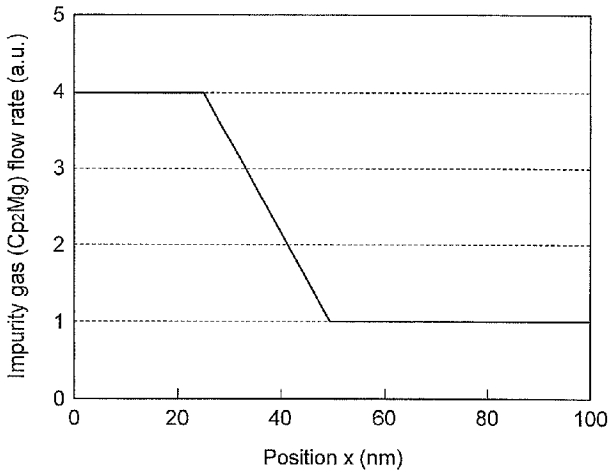
FIG. 15 is a graph showing a relationship between the position x (nm) and the impurity gas flow rate (a. u.).

FIG. 15 is a graph showing a relationship between the position x (nm) and the impurity gas flow rate (a. u.). In the second region, the amount of the impurity gas takes on a fixed value at (x=25 μm or less) and then gradually decreases from x=25 or more to 50 nm or less. The region for which x=50 nm or more is the first region 11 and the amount of the impurity gas takes on a fixed value. If the added amount (gas flow rate) of Mg in the first region 11 is set as 1, the maximum value of the added amount (gas flow rate) of Mg in the second region is four times thereof.

The numerical data for the case of Example 1 is as follows.

TABLE 1

| Position x (nm) | Al composition ratio X | Average value of Al composition ratio X in unit section | Impurity gas flow rate (a.u.) |
|---|---|---|---|
| 0 | 0 | — | 4 |
| 2.5 | 0 | 0.3 | 3.85 |
| 5 | 0.6 | | 3.7 |
| 7.5 | 0 | 0.268 | 3.55 |
| 10 | 0.536 | | 3.4 |
| 12.5 | 0 | 0.236 | 3.25 |
| 15 | 0.472 | | 3.1 |
| 17.5 | 0 | 0.2045 | 2.95 |
| 20 | 0.409 | | 2.8 |
| 22.5 | 0 | 0.1725 | 2.65 |
| 25 | 0.345 | | 2.5 |
| 27.5 | 0 | 0.1405 | 2.35 |
| 30 | 0.281 | | 2.2 |
| 32.5 | 0 | 0.1085 | 2.05 |
| 35 | 0.217 | | 1.9 |
| 37.5 | 0 | 0.077 | 1.75 |
| 40 | 0.154 | | 1.6 |
| 42.5 | 0 | 0.045 | 1.45 |
| 45 | 0.09 | | 1.3 |
| 47.5 | 0 | 0.013 | 1.15 |
| 50 | 0.026 | | 1 |

Figure 16:
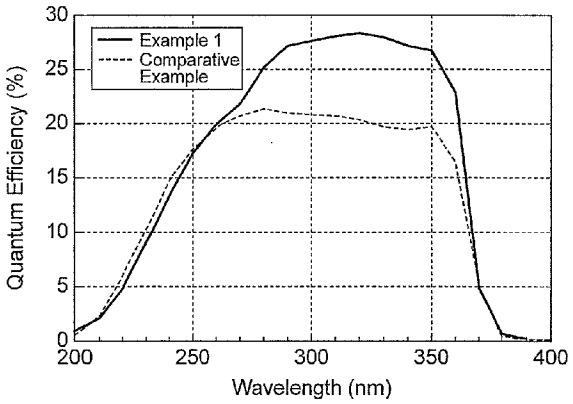
FIG. 16 is a graph showing relationships between the wavelength (nm) and the quantum efficiency (%).

FIG. 16 is a graph showing relationships between the wavelength (nm) and the quantum efficiency (%). With the comparative example, the entire compound semiconductor layer 1 is made up of the first region 11 in Example 1 and the thickness thereof was set to 108 nm. With Example 1, the thickness of the actual first region 11 was 57 nm and the total thickness of the compound semiconductor layer was set to 107 nm.

It can be understood that the quantum efficiency of Example 1 is made significantly higher than the quantum efficiency of the comparative example. Whereas with the comparative example, the quantum efficiency at the 280 nm wavelength used for flame detection applications never exceeded 25%, with Example 1, the band gap could be formed so as to cancel out the curving of the band due to the interface defect by adjusting the superlattice structure as described above and consequently, the region contributing to photoelectron emission could be enlarged to no less than 1.5 times that of the comparative example and the quantum efficiency could be improved significantly.

Also, the Al composition ratio is made high in the second region and the intermediate region so that the region not contributing to photoelectron emission can be improved in transmittance with respect to the 280 nm wavelength and the quantum efficiency is improved. Whereas with the comparative example, the quantum efficiency for light of 280 nm wavelength was 21.4%, with Example 1, the quantum efficiency was 25.2%. Also, whereas the maximum value of the quantum efficiency of the comparative example was 21.4% (280 nm), the quantum efficiency was improved to 28.4% (320 nm) in Example 1.

These principles can also be applied to Example 2 and it is thus considered that the quantum efficiency is increased similarly in the structure of Example 2 as well.

Also, although with each of the examples, GaN is used in the first region 11, even if this region is made to contain Al and be AlGaN, a quantum efficiency improvement effect of a certain level can be obtained because the energy peak position at the lower end of the conduction band can be adjusted based on analysis of the energy band gap. Also, although Mg was added as the p-type impurity, addition amounts to any of the various types of semiconductor layers may be adjusted freely within a range in which the energy band structure is not affected greatly. For example, Mg may be added to the non-doped GaN layer that is used during manufacture.

Although as the substrate 21 (FIG. 9) used during manufacture, Si is preferable from a standpoint that a GaN crystal of high quality can be obtained, a substrate of any of various types, such as sapphire, oxide compound, compound semiconductor, SiC, etc., may be used. Also, an impurity concentration of the Si substrate used during manufacture is approximately $5\times10^{18}$ $cm^{-3}$ to $5\times10^{19}$ $cm^{-3}$ and a resistivity of the substrate is approximately 0.0001 Ω·cm to 0.01 Ω·cm. As (arsenic) may be used as an n-type impurity.

Although as the semiconductor superlattice structure making up the buffer layer 22 (FIG. 9) used during manufacture, that with which the AlN layer and the GaN layer are laminated alternately is used, an AlGaN layer may be used in place of the AlN layer. An amount of impurity added to the superlattice structure is arbitrary, and although any of a p-type, n-type, or non-doped structure is possible, a non-doped structure is preferable from a standpoint of not forming any unnecessary crystallinity degradation factors. The thickness of the first layer (AlN) making up the buffer layer 22 is preferably $5\times10^{-4}$ μm to $500\times10^{-4}$ μm, that is, 0.5 to 50 nm, and the thickness of the second layer (GaN) is preferably $5\times10^{-4}$ μm to $5000\times10^{-4}$ μm, that is, 0.5 to 500 nm. In the composite layer in which a plurality of the first layers and a plurality of the second layers making up the buffer layer 22 are laminated, it is not necessary to make the thicknesses of the respective layers all equal. By using the buffer layer 22 with the above structure, a semiconductor functional layer of good flatness and good crystallinity can be obtained on the Si substrate. In the example described above, the thickness of the first layer (AlN) is set to 5 nm and the thickness of the second layer (GaN) is set to 25 nm. Although the thickness of the buffer layer 22 is 1200 nm, the number of layers may be increased to increase the thickness, for example, to 1800 nm.

The composition ratio X at each position may contain an error of ±10%. With the function described above, the energy of a region further toward the glass substrate side than the position of the energy hill at the lower end of the conduction band can be raised and the quantum efficiency can thereby be improved. The thickness D2 satisfies a relationship of being substantially equivalent to the thickness DM (within an error of ±50%) (D2=DM±DM×50%). Although in the embodiments described above, the intermediate region 1M is in respective contact with the first region 11 and the second region 12, AlGaN layers that would not affect the characteristics may be interposed in between the regions.

FIG. 17 is a partially broken-away front view of an image intensifier tube. The semiconductor photocathode described above was used to prepare the image intensifier tube.

In manufacturing the image intensifier tube, first, a glass substrate (faceplate) with the compound semiconductor layer 1 bonded thereto, an enclosure tube with an MCP (microchannel plate) built in, a phosphor output plate, and a Cs metal source are disposed in a vacuum chamber. Thereafter, air inside the vacuum chamber is evacuated and baking (heating) of the vacuum chamber is performed to increase a vacuum degree inside the vacuum chamber. A vacuum degree of $10^{-7}$ Pa was thereby attained after cooling of the vacuum chamber. Further, an electron beam is irradiated onto the MCP and the phosphor output plate to remove gases trapped in interiors of these components. Thereafter, the photoelectron emission surface of the glass substrate is cleaned by heating and in continuation, the Cs metal source is heated to make Cs and oxygen become adsorbed on the photoelectron emission surface (exposed surface of the compound semiconductor layer 1) to thereby activate and decrease an electron affinity of the photoelectron emission surface. Lastly, after using an indium sealing material to mount the glass substrate and the phosphor output plate on opposite open ends of the enclosure tube and seal the enclosure tube, the tube is taken out from inside vacuum chamber.

This image intensifier tube 101 is a proximity-focused image intensifier tube with which a photoelectric surface, the MCP (microchannel plate: electron multiplier portion), and the phosphor screen are disposed in proximity in the interior of a vacuum container that includes a side tube made of ceramic.

As shown in FIG. 17, an interior of the image intensifier tube 101 is maintained at a high vacuum by a substantially hollow and cylindrical side tube (enclosure tube) 102, with open opposite ends, being sealed in airtight manner at the opposite open end portions by a substantially disk-shaped entrance window (faceplate) 103 and a substantially disk-shaped exit window 104. That is, a vacuum container is arranged by the side tube 102, the entrance window 103, and the exit window 104.

The photoelectric surface (compound semiconductor layer 1) 105 is formed at a central region of a vacuum side surface of the entrance window 103. A photocathode 106 is arranged from the entrance window 103 and the photoelectric surface 105. Also, a phosphor screen 107 is formed at a central region of a vacuum side surface of the exit window 104. Further, between the photoelectric surface 105 and the phosphor screen 107, a disk-shaped MCP 108 is disposed in a state of facing the photoelectric surface 105 and the phosphor screen 107 with predetermined intervals being maintained in between.

The MCP 108 is held inside the side tube 102 by being sandwiched by two substantially ring-shaped electrodes 109B and 109C made of Kovar metal that make up a portion of the side tube 102. In detail, the MCP 108 is held inside the side tube 102 by its photoelectric surface 105 side surface being pressed by the electrode 109B via a conductive spacer 110 and a conductive spring 111 and its phosphor screen 107 side surface being pressed by the electrode 109C via a conductive spacer 112.

At a peripheral region of the vacuum side surface of the entrance window 103, a conductive film (not shown) made of metal is formed in a state of being in electrical contact with the photoelectric surface 105. The conductive film is put in electrical contact, via an indium 113, which is a junction member, with an electrode 109A, which is a substantially ring-shaped member made of Kovar metal for joining the side tube 102 and the entrance window 103 and makes up a portion of the side tube 102.

At a peripheral region of the vacuum side surface of the exit window 104, a conductive film (not shown) made of metal is formed in a state of being in electrical contact with the phosphor screen 107. The conductive film is put in electrical contact with an electrode 109D, which is a substantially ring-shaped member made of Kovar metal for joining the side tube 102 and the exit window 104. The electrode 109D is fitted in an inner side of an electrode 109E, which is a substantially cylinder-shaped member made of Kovar metal, and the electrode 109D and the electrode 109E are in mutual electrical contact. Further, the electrode 109D and the exit window 104 are sealed by a fitted glass 114. The electrodes 109D and 109E also make up a portion of the side tube 102.

The electrodes 109A, 109B, 109C, 109D, and 109E making up the side tube 102 are connected to an external power supply via unillustrated lead wires. Necessary voltages are applied by the external power supply to the photoelectric surface 105, the photoelectric surface side surface and the phosphor screen side surface (electron incidence side surface and electron emission side surface) of the MCP 108, and the phosphor screen 107. For example, approximately 200 V is set as a potential difference across the photoelectric surface 105 and the photoelectric surface side surface of the MCP 108, approximately 500 V to approximately 900 V is variably set as a potential difference across the photoelectric surface side surface and the phosphor screen side surface of the MCP 108, and approximately 6 kV to approximately 7 kV is set as a potential difference across the phosphor screen side surface of the MCP 108 and the phosphor screen 107.

Further, the side tube 102 is provided with an electrode 109F, which is a substantially ring-shaped member made of Kovar metal, and an inner side tip portion thereof is held across a predetermined distance from a side surface of the exit window 104. The electrode 109F is a current carrying electrode of an unillustrated getter.

The entrance window 103 is a glass faceplate with which central regions of the respective surfaces at an air side and the vacuum side are formed by processing synthetic quartz to a planar shape. The exit window 104 is a fiber plate arranged by bundling together a large number of optical fibers into a plate form. The phosphor screen 107 formed on the exit window 104 is formed by coating a phosphor onto the vacuum side surface of the exit window 104.

The side tube 102 has a multistep structure in which the pair of the electrode 109A and the electrode 109B, the pair of the electrode 109B and the electrode 109C, the pair of the electrode 109C and the electrode 109F, and the pair of the electrode 109F and the electrode 109E are respectively joined by sandwiching ceramic rings (side walls) 115A, 115B, 115C, and 115D that are ring-shaped ceramic members. That is, the side tube 102 is arranged by combining the ceramic members and the metal electrodes.

Although the image intensifier tube is a type of electron tube, the MCP may be omitted as necessary. The electron tube described above includes the semiconductor photocathode and the enclosure housing the electron emission surface (surface of the compound semiconductor layer 1 facing the MCP) of the semiconductor photocathode in a reduced pressure environment (vacuum), and electrons emitted from the semiconductor photocathode 1 in response to the incidence of light are collected by the phosphor screen 107 as the anode. The phosphor screen 107 emits fluorescence due to the incidence of electrons and the corresponding fluorescence image is output to the exterior via the exit window 104.

The image intensifier tube includes the semiconductor photocathode, the MCP 108 facing the electron emission surface of the semiconductor photocathode, the phosphor screen 107 (phosphor) facing the MCP 108, and the enclosure housing the electron emission surface (surface of the compound semiconductor layer 1 facing the MCP 108) of the semiconductor photocathode, the MCP 108, and the phosphor screen 107 as the anode in a reduced pressure environment (vacuum), and electrons emitted from the semiconductor photocathode 1 in response to the incidence of light are collected by the phosphor screen 107 as the anode and the fluorescence image formed there is output to the exterior via the exit window 104. The exit window 104 and the phosphor screen 107 may be arranged from a fluorescence block of a YAG crystal, etc., having a function that integrates these components.

As described above, with the above-described semiconductor photocathode, the quantum efficiency can be improved in comparison to the conventional GaN photocathode and image taking of high sensitivity can be performed by the image intensifier tube using the semiconductor photocathode.

Figure 19:
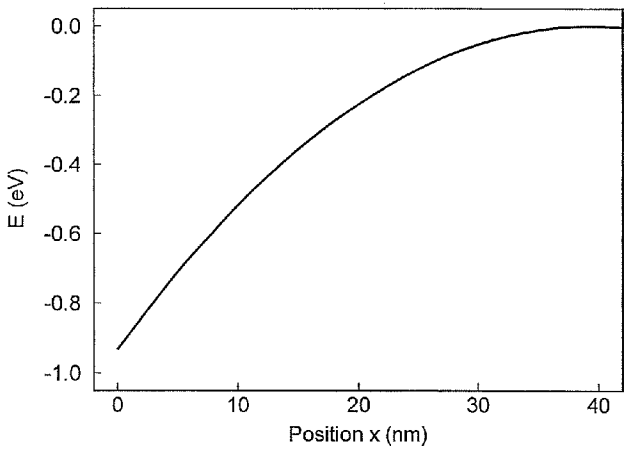
FIG. 19 is a graph showing a relationship between the position x (nm) and the energy E (eV) in the semiconductor photocathode.

FIG. 19 is a graph showing a relationship between the position x (nm) and the energy E (eV) in the conventional GaN photocathode. This energy level indicates the bottom level of the conduction band of the semiconductor layer. Here, an origin 0 of an x-axis is defined as an interface position between the compound semiconductor layer ($Al_xGa_{1-x}N$ (where X=0)) 1 and the adhesive layer ($SiO_2$ layer) 2 and x is defined as a position in a thickness direction of the compound semiconductor layer 1 from the interface toward the alkali-metal-containing layer 4 (vacuum side). The semiconductor layer is made of only GaN layer and the thickness thereof is set to 95 nm.

According to some transmission mode and reflection mode experiments by the inventors, the it was found that the highest energy E (eV) in GaN layer was positioned at about x=40 nm because of the electric field generated by carries from interface defects and spontaneous polarization in GaN layer. In FIG. 19, this highest energy E is defined as 0 (eV). The energy barrier made by the curved energy E in a region below x=40 nm interrupts the passing of the electrons generated in a region below x=40 nm toward the vacuum. In order to reduce the energy barrier, the composition ratio X of Al should be increased in the semiconductor layer.

Figure 20:
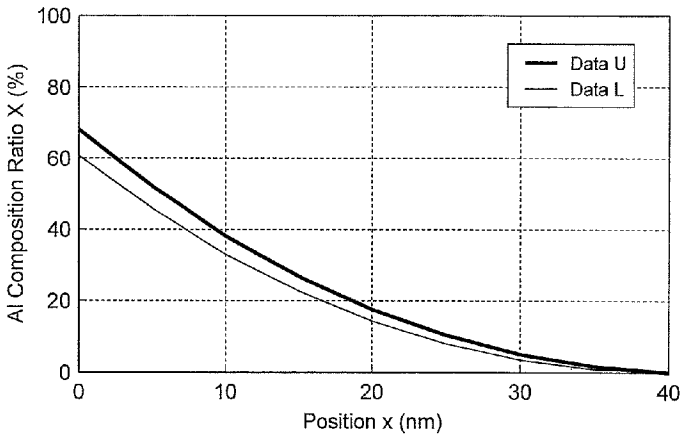
FIG. 20 is a graph showing relationships between the position x (nm) and the Al composition ratio X (%) in the semiconductor photocathode.

FIG. 20 is a graph showing relationships between the position x (nm) and the Al composition ratio X (%) in the semiconductor photocathode. As stated above, the second region 12 and the intermediate region 1M both include Al as their constitutional material of the semiconductor crystals. Data L in FIG. 20 shows the Al composition ratio X that can flatten the energy E in a semiconductor region below 40 nm in FIG. 19. The effective Al composition ratio X at the interface position between the semiconductor layer and the glass is 61%, and this value is the maximum of Data L.

Since each of the second region 12 and intermediate section 1M has the superlattice structure, FIG. 20 shows the effective Al composition X, this composition X being the average in the unit section of the superlattice structure (MQW (multiple quantum well) structure). That is, the Al composition ratio X is expressed by the average Al composition ratio in the unit section, the unit section being consisting of adjacent barrier and well layers in superlattice structure. In a case when the superlattice structure is not used in the semiconductor region, the effective Al composition ratio X simply indicates the Al composition ratio X.

Data U in FIG. 20 shows the Al composition ratio X that can make a slope or a gradient in the energy E in the semiconductor region below 40 nm in FIG. 19. The energy slope is inclined to the vacuum side. In this case, the generated electrons in the conduction band can easily flow toward the vacuum side followed by the energy slope. The effective Al composition ratio X at the interface position between the semiconductor layer and the glass is 68%, and this value is the maximum of Data U.

A photocathode having a selective sensitivity for wavelength shorter than 300 nm has been expected. When the effective Al composition ratio X in the vacuum side semiconductor region (intermediate region 1M or the first region 11) is set to 30% or more, this region can generates electrons in response to light having wavelength of 300 nm or shorter.

In order to selectively detect light having short wavelength, the energy band gap should be increased, because maximum detectable wavelength λ (nm) and the energy band gap Eg (eV) satisfy the expression λ=1240/Eg. When λ=300 (nm), Eg=4.13 (eV). The energy band gap of GaN=3.4 (eV) and the energy band gap of AlN=6.2 (eV). Al composition ratio X that provides the energy band gap of 4.13 (eV) can be simply calculated by supposing that the relationship between the energy band gap and Al composition ratio X is proportional, and the calculated Al composition ratio X is 26.4(%). Actually, the real energy band gap is a little smaller than 4.13 (eV) when using this calculated value X=26.4(%). Therefore, the effective Al composition ratio X is set to 30(%), this value is a little bigger than 26.4(%).

The effective Al composition ratio X will be explained in more detail below. As stated above, the effective Al composition ratio X is given by the average of Al composition ratio X in the unit section of the superlattice structure. When the second region 12 and the intermediate region 1M are comprised of the superlattice structure, the effective Al composition ratio can be set as follows. The values are rounded to the whole number. Note that Example 3 shows Data L and Example 4 shows Data U. The first region 11 is made of GaN (X=0).

TABLE 2

| | Region 12 | | Region 1M | |
|---|---|---|---|---|
| | Maximum Effective Al composition ratio X (%) (x = 0) | Minimum Effective Al composition ratio X (%) (x = xa) | Maximum Effective Al composition ratio X (%) (x = xa) | Minimum Effective Al composition ratio X (%) (x = xb) |
| Example 1 | 30 | 15 | 15 | 0 |
| Example 2 | 40 | 40 | 40 | 0 |
| Example 3 | 61 | — | — | 0 |
| Example 4 | 68 | — | — | 0 |

Figures 21, 22:
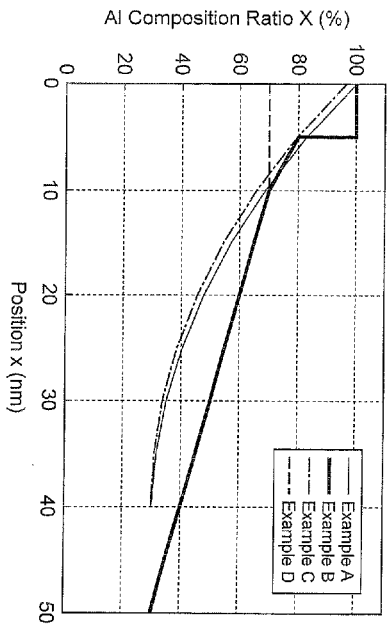
FIG. 21 is a graph showing relationships between the position x (nm) and the Al composition ratio X (%) in the semiconductor photocathode.
FIG. 22 is a table showing the physical quantities of the semiconductor layers of the photocathode.

FIG. 21 is a graph showing relationships between the position x (nm) and the Al composition ratio X (%) in the semiconductor photocathode. This Al composition ratio X indicates the effective Al composition ratio X when the semiconductor layers are formed by the superlattice structure.

According to Example B, the Al composition ratio X in a region where x is less than 5 nm is 100% and constant, and this region is comprised of AlN. In a region where the position x is greater than 5 nm, the Al composition ratio X gradually decreases with increasing the position x. The thickness of the second region 12 is 5 nm and the thickness of the intermediate region 1M is 45 nm. In Example B, the first region 11 is made of AlGaN (X=30%) and formed on the intermediate region 1M.

According to Examples A and C, the Al composition ratio X gradually decreases with increasing the position x till the ratio X becomes 30%. In Examples A and C, the thickness of the second region 12 is 20 nm and the thickness of the intermediate region 1M is 20 nm. The first region 11 is made of AlGaN (X=30%) and formed on the intermediate region 1M.

According to Example D, the Al composition ratio X in a region where x is less than 10 nm is 70% and constant, and the ratio X gradually decreases with increasing the position x till the ratio X becomes 30%. In Example D, the thickness of the second region 12 is 10 nm and the thickness of the intermediate region 1M is 30 nm. The first region 11 is made of AlGaN (X=30%) and formed on the intermediate region 1M. The effective Al composition ratio X is as follows. The values are rounded to the whole number.

TABLE 3

| | Region 12 | | Region 1M | |
|---|---|---|---|---|
| | Maximum Effective Al composition ratio X (%) (x = 0) | Minimum Effective Al composition ratio X (%) (x = xa) | Maximum Effective Al composition ratio X (%) (x = xa) | Minimum Effective Al composition ratio X (%) (x = xb) |
| Example A | 100 | — | — | X(11) = 30 |
| Example B | 100 | 100 | 80 | X(11) = 30 |
| Example C | 97 | — | — | X(11) = 30 |
| Example D | 70 | 70 | 70 | X(11) = 30 |

Note that Example A can flatten the Energy E in a region where x is less than 40 nm shown in FIG. 19. Example C can make the Energy slope inclined to the vacuum side in a region where x is less than 40 nm.

In Examples 1 to 4, the effective Al composition ratio X(11) in the first region 11 is set to 0 (X(11)=0%). When X=0 in the first region 11, the sensitivity becomes high because of the good crystallinity of the first region 11. However, the effective Al composition ratio X(11) can be changed. For example, the effective Al composition ratio X(11) can be set in a range from 0(%) to 30(%). That is, 0(%)≤X(11)≤30(%).

When the effective Al composition ratio X (constant or the maximum value) in the second region 12 is 15(%), the sensitivity increased because of the change in energy E in a region below 40 nm. The crystal growth of AlGaN is limited by the composition ratio X(11)+50(%) or X(11)+30(%). Therefore, the maximum effective Al composition ratio X(12(Max)) in the second region 12 can be set in a range from 15(%) to X(11)+50(%) or X(11)+30(%). That is, the following expressions are satisfied. According to the result of the experiment of X(11)=0(%), when the maximum X(12(Max)) is set to be X(11)+30(%), high sensitivity can be expected. Further, the maximum of X(12(Max)) is set to be X(11)+50(%) if considering two conditions, one of the condition being the suitable Al composition ratio X obtained from the estimated bending model of conduction band (FIG. 19) and, the other condition being the change ratio of Al composition ratio X that can make sufficient crystallinity.

$$15(\%) \leq X(12(\mathrm{Max})) \leq X(11)+50(\%), \text{ or} \quad (1)$$

$$15(\%) \leq X(12(\mathrm{Max})) \leq X(11)+30(\%). \quad (2)$$

Further, the above Al composition ratio can be used for normal semiconductor structure (bulk) that does not have the superlattice structure. In this case, Al composition changed continuously with increasing the position x.

When the effective Al composition ratio X in the second and intermediate regions 12, 1M made of superlattice structure is constant through the regions, and the effective Al composition ratio X in the first region 11 is lower than this constant value (=X(12:const)), the sensitivity can be increased because of the reason that the energy E in a region where position x is less than 40 nm can be flattened. In this case, X(11) and X(12:const) can satisfy the following expressions.

$$30(\%) \leq X(11) \leq 40(\%). \quad (1)$$

$$60(\%) \leq X(12{:}\mathrm{const}) \leq X(11)+50(\%), \text{ or} \quad (2)$$

$$60(\%) \leq X(12{:}\mathrm{const}) \leq X(11)+30(\%). \quad (3)$$

X(11) can be set in a range from 30% to 40%, because when using this value as shown in FIG. 22, the quantum efficiency increased. When 30(%)≤X(11)≤40(%), good sensitivity can be obtained. When 60(%)≤X(12:const)≤X(11)+50(%), or 60(%)≤X(12:const)≤X(11)+30(%), the sensitivity is clearly increased.

According to the result of the experiment of X(11)=0(%), when the maximum X(12:const) is set to be X(11)+30(%), high sensitivity can be expected. Further, the maximum of X(12:const) is set to be X(11)+50(%) if considering two conditions, one of the condition being the suitable Al composition ratio X obtained from the estimated bending model of conduction band (FIG. 19) and, the other condition being the change ratio of Al composition ratio X that can make sufficient crystallinity.

FIG. 22 is a table showing the physical quantities of the semiconductor layers (the second region 12 (superlattice structure), the intermediate region 1M (superlattice structure), and the first region 11(normal bulk structure and no change in Al composition ratio)) of the photocathode. There are 6 sample lot No. 1 to No. 6 in FIG. 22. No. 1 includes 3 samples, No. 2 includes 2 samples, No. 3 includes 2 samples, No. 4 includes 1 sample, No. 5 includes 1 sample, No. 6 includes 3 samples and each relevant value of the sample lots indicates the average among the relevant sample lot. The effective Al composition ratio X in region 12 is constant and the effective Al composition ratio X in region 1M is graded. The effective Al composition ratio X is changed from 0% to 40% in region 12, and X is also changed in the layer 1M. The Al composition ratio X in FIG. 22 indicates the effective Al composition ratio X because region 12 and region 1M both are made of superlattice structures. The thickness of region (layer) 12 varies from 0 nm to 25 nm, and the thickness of region (layer) 1M varies from 25 nm to 50 nm. The first region 11 (GaN (X=0%)) having the thickness of about 50 nm is formed on the intermediate region 1M. That is, the thickness of the first region was varied from 20 nm to 60 nm confirm the effect. In these cases the Quantum efficiencies were also high. The sensitivity becomes high when this thickness of the first region is equal to or under 100 nm. This thickness of the first region can be set in a range from 10 nm to 100 nm.

In order to create a superlattice structure, the Al composition ratio X alternately changed by the well layer and the barrier layer in the superlattice structure. When the effective Al composition ratio is X, the real maximum Al composition ratio of the barrier layer in the unit section is set to 2X, and the real minimum Al composition ratio of the well layer in the unit section is set to 0 (GaN). In this case, the average Al composition ratio in the unit section is (2X+0)/2=X.

Figure 23:
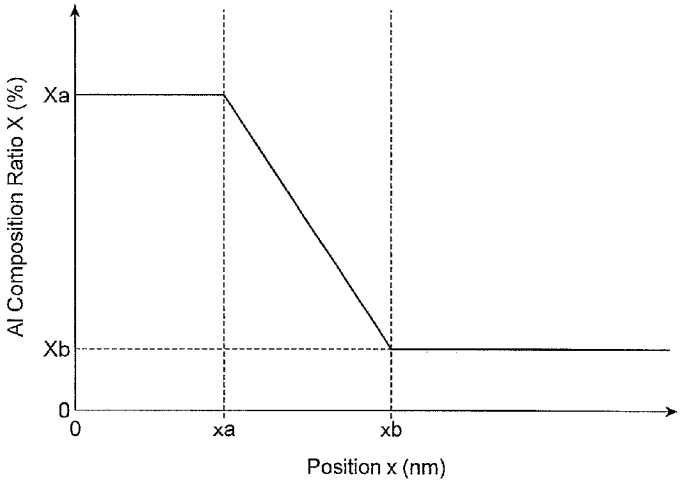
FIG. 23 is a graph showing a relationship between the position x (nm) and Al composition ratio X (%) in the semiconductor photocathode.

FIG. 23 is a graph showing a relationship between the position x (nm) and Al composition ratio X (%) in the semiconductor photocathode. The effective Al composition ratio X is constant (=Xa) in the second region 12 (region of 0≤x≤xa) and decreases with the increasing position x in the intermediate region 1M (region of 0≤x≤xa) till the X becomes Xb. The effective Al composition ratio X is constant (=Xb) in the first region 11 (region of xb≤x). The minimum effective Al composition ratio Xb can be set in the range of X(11).

Figure 24:
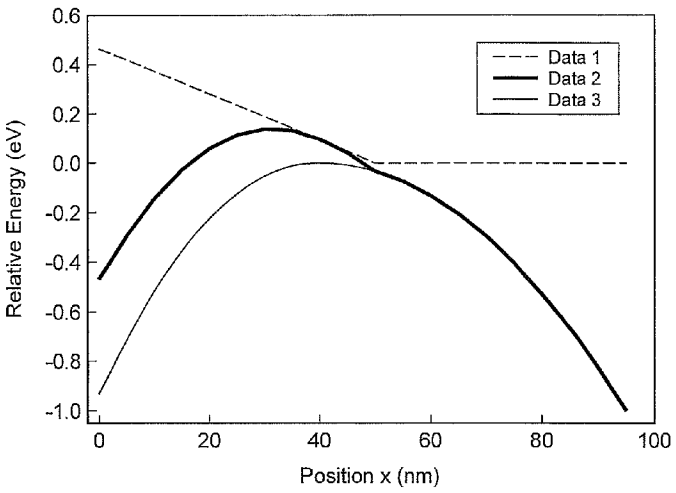
FIG. 24 is a graph showing a relationship between the position x (nm) and relative energy (eV) in the semiconductor photocathode.

FIG. 24 is a graph showing a relationship between the position x (nm) and relative energy (eV) in the semiconductor photocathode. When increasing the Al composition ratio in a region where x is less than 40 nm or 50 nm, the energy in the semiconductor changes. Data 3 shows the original lowest energy in the conduction band of GaN. The energy level is curved by the carries from interface defects and spontaneous polarization in GaN. When the Al composition ratio X is increased to form the energy as indicated by Data 1, the energies of Data 3 and 1 are superimposed to form the energy curve indicated by Data 2. This structure lowers the energy barrier around 40 nm in the semiconductor layer to increase the amount of electrons that can reach to the vacuum. According to this structure, the distance from the top position (Maximum value) of Data 2 to the exposed surface of the first region 11 can be the effective thickness (=Δx) for the photoelectric conversion of the photocathode.

Figure 25:
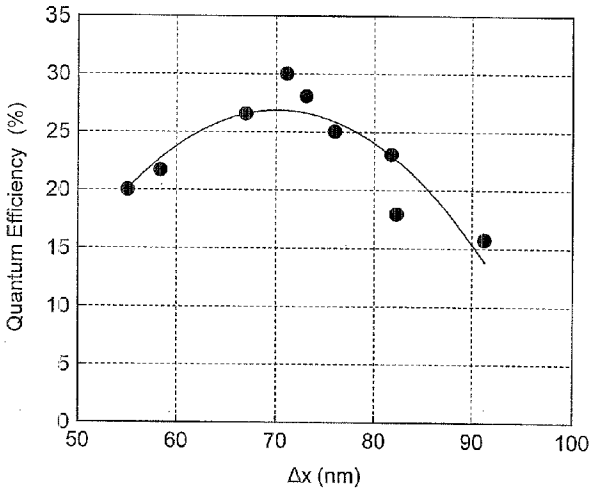
FIG. 25 is a graph showing a relationship between Δx (nm) and quantum efficiency (%) of the semiconductor photocathode.

FIG. 25 is a graph showing a relationship between the effective thickness Δx (nm) and quantum efficiency (%) of the semiconductor photocathode.

When the effective thickness Δx (nm) was set in a range from 55 nm to 91 nm, the quantum efficiency (%) (at wavelength of 280 nm) of the photocathode could be 16% to 30%. When the effective thickness Δx (nm) was set in a range from 67 nm to 76 nm, the quantum efficiency (%) of the photocathode could be over 25%. The data indicated by the effective thicknesses Δx (nm) of 55 nm, 58 nm, 67 nm, 71 nm, 73 nm, 76 nm, 82 nm, 83 nm, and 92 nm in FIG. 25 is obtained from by sample lot No. NE5733, No. 3, No. 5, No. 1, No. 1, No. 6, No. 3, No. 2, No. 2 respectively.

Figure 26:
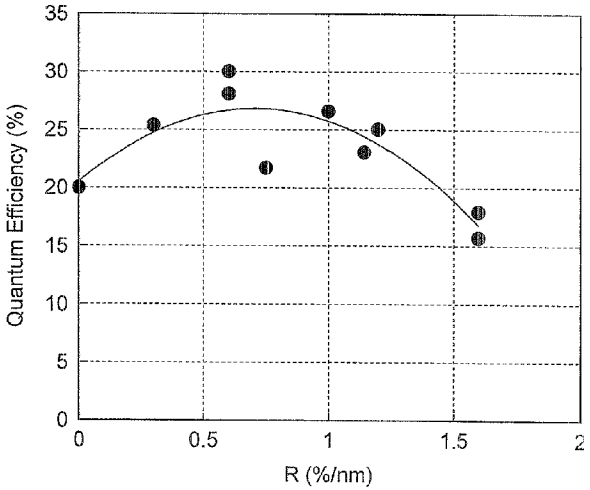
FIG. 26 is a graph showing a relationship between R (%/nm) and quantum efficiency (%) of the semiconductor photocathode.

No. NE5733 only comprises the first region of a bulk GaN. The thickness of the first region is 95 (nm). No. NE5733 comprises neither the second region (AlGaN) nor the intermediate region (AlGaN). FIG. 26 is a graph showing a relationship between composition gradient R (%/nm) and quantum efficiency (%) of the semiconductor photocathode. R indicates the change in the effective Al composition ratio X in a unit thickness. The data indicated by R of 0, 0.3, 0.6 (high QE), 0.6 (low QE), 0.75, 1, 1.2, 1.25, 1.6 (high QE), 1.6 (low QE) in FIG. 26 is obtained from by sample lot No. NE5733, No. NE6420, No. 1, No. 1, No. 4, No. 5, No. 4, No. 6, No. 2, No. 2 respectively. No. NE6420 is a sample having structure shown in Example 1, and the thickness D2 of the second region 12 is 25 nm, the thickness DM of the intermediate region 1M is 25 nm, the thickness D1 of the first region 11 of GaN is 51 nm, the maximum effective Al composition ratio X in the superlattice structure in the second region 12 is 15%, the maximum effective Al composition ratio X in the superlattice structure in the intermediate region 1M is 7.5%, and R is 0.3(%/nm). When the effective Al composition ratio greatly changes, the quantum efficiency decreases. When the composition gradient (composition changing rate) R (%/nm) is 1.2(%/nm) or less, especially is in a range from 0.3(%/nm) to 1.2 (%/nm), the quantum efficiency can be increased and the quantum efficiency is over 25%.

As stated above, FIG. 16 shows the relationship between the wavelength (nm) and quantum efficiency (%) of the semiconductor photocathode. This graph is obtained by the sample lot No. 1. According to FIG. 16, very high quantum efficiency over 30% is obtained. This value is greater than the quantum efficiency obtained by the normal bulk GaN photocathode (comparative example).

Next, a semiconductor photocathode according to another embodiments and the manufacturing method are explained below. The following embodiments are also related to the semiconductor photocathode emitting electrons in response to the incident light and manufacturing method.

Semiconductor photocathodes according to embodiments shall now be described. The same symbols shall be used for elements that are identical to each other and redundant description shall be omitted. Note that the following semiconductor photocathodes can be applied to also the above image intensifier, and the manufacturing method is identical to the method explained above.

First, a photocathode according to a comparative example (Type 1) shall be described.

FIG. 27 is a longitudinal sectional view of the semiconductor photocathode according to the comparative example (Type 1). The photocathode includes a compound semiconductor layer 1 made of GaN, an adhesive layer 2 made of $SiO_2$, a glass substrate 3, and an alkali-metal-containing layer 4 made of an alkali photocathode material. The compound semiconductor layer 1 is bonded to the glass substrate 3 via the adhesive layer 2, and after the bonding of the compound semiconductor layer 1 in a manufacturing process, the alkali photocathode material is deposited on an exposed surface of the compound semiconductor layer 1. Such a photocathode that is bonded to a glass substrate shall hereinafter be referred to as a glass bonded structure.

Silica, which makes up the glass substrate 3, is a "UV glass" that transmits ultraviolet rays and is made of borosilicate glass. As a borosilicate glass, for example, Kovar glass is known. Such a glass is made high in transmittance in a wavelength range of no less than approximately 185 nm wavelength, and "9741," made by Corning Inc., "8337B," made by Schott A G, etc., may be used. Such a UV glass is higher than sapphire in ultraviolet transmittance at least at no less than 240 nm and is higher than sapphire in absorbance with respect to infrared rays with a wavelength of no less than 2 μm.

As the alkali photocathode material used in the alkali-metal-containing layer 4, Cs—I, Cs—Te, Sb—Cs, Sb—Rb—Cs, Sb—K—Cs, Sb—Na—K, Sb—Na—K—Cs, Ag—O—Cs, Cs—O, etc., are known. In the present example, Cs—O, which is an alkali oxide, is used as the alkali photocathode material. An alkali metal has a function of lowering a work function and imparting a negative electron affinity to facilitate emission of electrons into a vacuum level.

Here, an origin 0 of an x-axis is defined as an interface position between the compound semiconductor layer ($Al_XGa_{1-X}N$ (where X=0)) 1 and the adhesive layer ($SiO_2$ layer) 2 and x is defined as a position in a thickness direction of the compound semiconductor layer 1 from the interface toward the alkali-metal-containing layer 4. With the present semiconductor photocathode, light is made incident from the glass substrate 3 side, is transmitted through the adhesive layer 2, and arrives at the compound semiconductor layer 1. Photoelectric conversion is performed in the compound semiconductor layer 1 and electrons generated in correspondence to the incident light are emitted into vacuum via the alkali-metal-containing layer 4.

FIG. 28A is a sectional view and FIG. 28B is an energy band diagram of the compound semiconductor layer (GaN) 1 of the photocathode according to the comparative example.

Here, t is defined as a thickness with which a minute thickness of the alkali-metal-containing layer 4 is added to a total thickness D of the compound semiconductor layer 1. It is considered that, in the same manner as in a behavior of an energy band gap in a GaAs transmission type photocathode with a glass bonded structure or in a Si-based device, a defect level is formed at the heterojunction interface of the glass and the GaN crystal and, due to an electric field formed by carriers from this level, an energy band curve that decreases from the crystal toward the interface is formed. Meanwhile, a band curve that decreases toward the vacuum side is formed at a vacuum side surface of a p-type semiconductor. It is presumed that in the transmission type GaN photocathode, the effects of the two curves combine within a thin thickness of 100 nm to form a hill-shaped energy band.

In a transmission mode operation, an electron excited at a light incidence side of a peak of the hill of the band structure (an emission disabled region R(I) of $0<x<x_P$) cannot surpass the peak and move to a vacuum side slope and thus cannot be emitted into vacuum. In a case where the photocathode is put in a reflection mode operation, light is made incident from the vacuum side and electrons exit to the right side. The position of the peak of the band hill is thus important. Although in both operation modes, a region that functions effectively as a photocathode is a region at the vacuum side of the peak (an emission contributing region R(II) of $x_P<x<t$), in the transmission mode, much light is absorbed in a region at the light incidence side of the band peak and therefore an amount of light that enters the region at the right side, which practically operates as the photocathode, is considerably reduced. Oppositely, in the reflection mode, the region in which much light is absorbed contributes to photoelectron emission and high sensitivity is thus achieved.

To test this hypothesis, a quantum efficiency of the photocathode according to the comparative example (Type 1) was measured.

Figure 29:
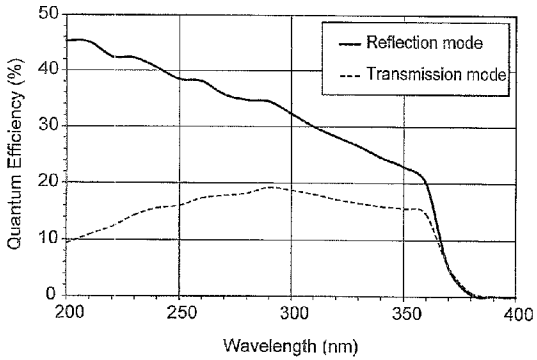
FIG. 29 is a graph showing the relationship between the wavelength (nm) and the quantum efficiency (%).

FIG. 29 is a graph showing relationships between wavelength (nm) and the quantum efficiency (%) of the photocathode according to the comparative example.

Spectral sensitivities in the transmission mode and the reflection mode of the transmission type structure photocathode sealed in a photoelectric tube are shown in this figure. The photocathode has a thickness of 127 nm. Although the present inventors have thus far prepared a transmission type photocathode of the glass bonded structure and a transmission type photocathode using GaN grown on sapphire substrates, a maximum quantum efficiency that was obtained was no more than 25%. On the other hand, when a reflection type GaN photocathode with the glass bonded structure of Type 1 was sealed in a photoelectric tube and the sensitivity measured, whereas a high value of quantum efficiency of 35% was obtained at a wavelength of 280 nm, the quantum efficiency in the transmission mode was found to be lower than that in the reflection mode. This verifies that the energy band gap is curved as described above.

Figure 45:
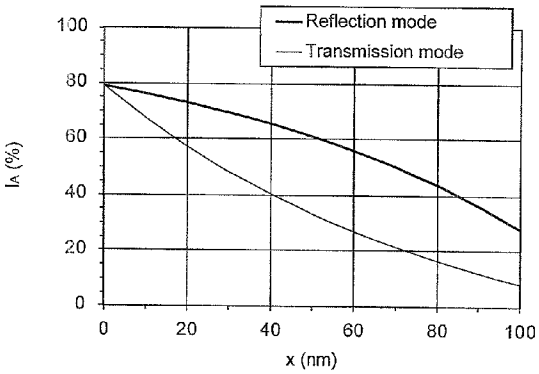
FIG. 45 is a graph showing the relationship between the position x (nm) and the light absorption amount $I_A$(%) of the compound semiconductor layer.

A position xp of the peak of the energy band gap hill is determined based on the above concepts. The expressions used in the explanation are shown in FIG. 47. The position x shown in the expressions (1) to (12) in FIG. 47 are identical to that in FIG. 28B in the transmission mode. The position x shown in the expressions (1) to (12) in FIG. 47 differ from that in FIG. 28B in the reflection mode, and the position of the light incident surface is regarded as the origin, and the direction from the origin toward the deep portion of the compound semiconductor layer 1 is defined as the positive direction. In both of the modes, the light absorption amount (%) decreases when the distance from the incident light surface becomes large. FIG. 45 shows the relationship between the position x and the light absorption amount $I_A$ (%) in this case. The light absorption amount in the reflection mode is larger than the light abruption amount in the transmission mode.

The quantum efficiencies of the reflection mode operation and the transmission mode operation can be estimated using the results of FIG. 29 and a complex refractive index of GaN. Light made incident on a substance is absorbed a little at a time at each location of passage and an intensity at a position of distance x from an incidence surface is in accordance with Lambert's law, and it is expressed by the expression (1). $I_0$ indicates the incident light intensity, $\alpha$ indicates the absorption coefficient. The absorption coefficient $\alpha$ is expressed by the expression (2) by using extinction coefficient of the complex refraction index. $\lambda$ indicates wavelength of light. The number $n_A$ of excited electrons in the minute section $\Delta x$ at a certain position in the photocathode is proportional to the number of absorbed photons in this section.

Since the number of absorbed photons is proportional to the change in the light intensity in the minute section $\Delta x$, the expression (3) is obtained by using the derivative of the expression (1). In this GaN photocathode, when focusing attention on the electrons contributing to the photoelectron emission, all of the excited electrons can move to vacuum side by the conduction band slop Therefore, the number $n_S$ of electrons that reach to the vacuum side interface is given by the expression (4).

Where, f indicates the probability of living of electrons after electrons reach to the vacuum side interface, the distance from the excited position to the vacuum side interface and the diffusion length L are used as parameters. In order to simplify the calculation, the transmission of electrons are supposed to be limited in one dimension. The inventor supposes the expression (5) as the function f in the reflection mode operation, and supposes the expression (6) as the function f in the transmission mode operation. In this case, the expression (3) is modified to the expression (7) for the reflection type, the expression (3) is modified to the expression (8) in the transmission type. The thickness of a part (a part of compound semiconductor layer 1 and alkali metal containing layer 4) is defined as t, this part being a part of photocathode where the glass substrate is eliminated. The physical property of the alkali metal containing layer 4 is supposed to be identical to that of the compound semiconductor layer 1.

Therefore, the total number of electrons that can reach to the vacuum side interface can be calculated by adding the result of expressions (6) and (7) in the respective regions where the excited electrons can reach to the vacuum. That is, the expression (9) is obtained for the reflection type, and the expression (10) is obtained for the transmission type.

The integrating regions in the calculation are limited in regions effective for the photoelectron emission in the case of the reflection type operation and transmission type operation. When calculating the above definite integral, expression (11) is obtained for the reflection type, expression (12) is obtained for the transmission type.

Further, these values are respectively multiplied by the probability of escaping electrons from the surface to the vacuum as coefficient, and the results are divided by the incident light intensity $I_0$, and the quantum efficiency is obtained by this calculation. The values 235 nm and 0.5 have been determined respectively for the electron diffusion length and the escape probability in a report by Fuke et. al. (S. Fuke, M. Sumiya, T. Nihashi, M. Hagino, M. Matsumoto, Y. Kamo, M. Sato, K. Ohtsuka, "Development of UV-photocathode using GaN film on Si substrate," Proc. SPIE 6894, 68941F-1-68941F-7 (2008)). A calculated value of a ratio of the quantum efficiencies of the reflection mode and the transmission mode and an actual measurement value of the ratio of the quantum efficiencies can be compared. Where, the expression (11) is divided by the expression (12) in order to compare the ratio of quantum efficiencies in the reflection mode and the transmission mode with the measured values. By this calculation, the influence of the probability of escaping can be eliminated.

In order to avoid influences of absorption of the glass surface plate on which the GaN crystal is bonded, a comparison is made in a range of no less than 290 nm. Results in cases where the diffusion length is set to 235 nm and the position xp of the band hill is set to 40 nm, 52 nm, and 60 nm from the surface were compared with actual measurement values. The results are shown in FIG. 4.

Figure 30:
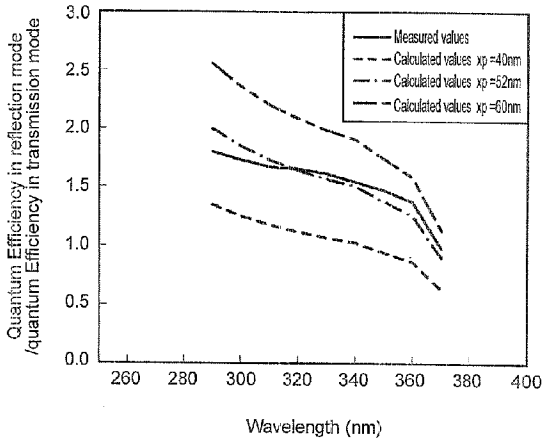
FIG. 30 is a graph of wavelength dependences of quantum efficiency in a reflection mode/quantum efficiency in a transmission mode for cases where a peak position xp of a lower end of the energy band is changed.

FIG. 30 is a graph of wavelength dependences of the (quantum efficiency in the reflection mode/quantum efficiency in a transmission mode) for cases where the peak position xp of the lower end of the energy band is changed. With regard to the position xp of the energy band hill, the actual measurement values and the calculated values were in the best agreement when xp=52 nm.

It thus became clear that the peak of the energy hill of the conduction band (lower end) is substantially at a center (position of D/2) (slightly closer to the glass junction interface) of the thickness (total thickness D) of the compound semiconductor layer 1. With a GaN photocathode with a thickness of approximately 100 nm, although half of the thickness of the photocathode does not contribute to photoelectron emission in both the reflection mode and the transmission mode, a larger amount of light is absorbed at the side at which light is made incident and this is a cause of the quantum efficiency being lower in the transmission mode than in the reflection mode.

That is, to improve the quantum efficiency, it is important to shift the peak position xp, which is positioned at substantially the center of the compound semiconductor layer 1, toward the glass substrate side. In semiconductor photocathodes according to examples, exceptionally high quantum efficiencies can be obtained by shifting the peak position xp toward the glass substrate side and further widening the energy band gap Eg at the glass substrate side.

FIG. 31 is a longitudinal sectional view of a semiconductor photocathode according to an example (Type 2 or Type 3). Differences with respect to the semiconductor photocathode of the comparative example (Type 1) are that the compound semiconductor layer 1 is made up of three regions 11, 1M, and 12 and Al is added to GaN, and structures of other portions are the same as those of the comparative example.

The semiconductor photocathode according to each of the examples includes the compound semiconductor layer 1 ($Al_XGa_{1-X}N$ layer ($0 \leq X < 1$)) bonded to the glass substrate 3 via the adhesive layer 2 made up of the $SiO_2$ layer and the alkali-metal-containing layer 4 formed on the $Al_XGa_{1-X}N$ layer. The $Al_XGa_{1-X}N$ layer making up the compound semiconductor layer 1 includes a first region 11 adjacent to the alkali-metal-containing layer 4, a second region 12 adjacent to the adhesive layer 2 made up of the $SiO_2$ layer, and an intermediate region 1M positioned between the first region 11 and the second region 12.

Here, x is defined as a position in a thickness direction of the compound semiconductor layer 1 ($Al_XGa_{1-X}N$ layer) from the second region 12 toward the alkali-metal-containing layer 4 and an origin 0 of the position x is set at the interface position between the second region 12 and the adhesive layer 2 made of the $SiO_2$ layer.

Here, if the Al composition ratio X is given as X=g(x), the following conditions (1) to (5) are satisfied with $X_{MIN(M)}$ being the minimum value of the composition ratio X in the intermediate region 1M and $X_{MIN(2)}$ being the minimum value of the composition ratio X in the second region 12.

(1): In the first region 11, $0 \leq g(x) \leq X_{MIN(M)}$ is satisfied.

(2): In the intermediate region 1M, g(x) is a monotonously decreasing function and satisfies $g(x) \leq X_{MIN(2)}$.

(3): In the second region 12, g(x) is a monotonously decreasing function or is a fixed value.

(4): In a case where g(x) in the second region 12 is a monotonously decreasing function, a thickness D1 of the first region is no less than 18 (nm).

(5): In a case where g(x) in the second region 12 is a fixed value, the thickness D1 of the first region 11 is no less than 31 (nm).

In a case where the Al composition ratio X and the thickness D1 of the first region satisfy the above conditions, the quantum efficiency can be improved exceptionally compared to the conventional GaN photocathode.

Although the Al composition ratio X of the first region 11 is preferably 0 and this region is preferably made of GaN, this region may contain a low concentration of Al.

With the examples, two types of photocathodes are prepared. The semiconductor photocathode of Type 2 satisfies the condition (4) and the photocathode of Type 3 satisfies the condition (5). In the case where the Al composition ratio X decreases monotonously, the maximum value and the minimum value are respectively defined at the two interface positions of the corresponding semiconductor layer and although in principle, the composition ratio changes at a fixed slope between the two positions, in an actual product, the composition ratio X does not necessarily change always at a fixed proportion with respect to a change of position in the thickness direction due to inclusion of manufacturing error.

FIG. 32A is a sectional view and FIG. 32B is an energy band diagram of the compound semiconductor layer (AlGaN based laminar structure) according to each example. In comparison to the semiconductor photocathode of the comparative example, the peak position xp of the energy level of the lower end of the conduction band is shifted more toward the glass substrate side than a central position in the thickness direction of the compound semiconductor layer 1. This is due to making the Al composition ratio X higher at the glass substrate side than at the central position and the electron emission disabled region R(I) is thereby decreased and the emission contributing region R(II) is increased. At a vicinity of the glass substrate, the Al composition ratio X is no less than 0.3 and transmittance of light of short wavelength (wavelength: 280 nm) in this disabled region is thereby increased so that an amount of light that is photoelectrically converted at the emission contributing region is increased.

D is the total thickness of the compound semiconductor layer 1 ($Al_xGa_{1-x}N$ layer), D1 is the thickness of the first region, DM is a thickness of the intermediate layer, D2 is a thickness of the second region 12, and E is an allowable error. As described above, to dramatically improve the quantum efficiency, it is important to adjust the energy band gap of the region positioned more to the glass substrate side than the central position (D/2).

That is, the semiconductor photocathodes of the examples satisfy the following relational expressions:

$$(D2+DM)\times(100\pm E)\%=D/2,$$

$$E\leq 60$$

In a case where the compound semiconductor layer 1 is uniform in composition, the peak of the energy level of the lower end of the conduction band is positioned near the position of one-half of the thickness D, and therefore by adjusting the energy level at the glass substrate side of the peak position xp by means of the intermediate region 1M and the second region 12, electrons that cannot be emitted into vacuum can be transitioned to a higher energy level and an electron emission probability can thereby be increased in principle. Although it is considered that an increase in the electron emission efficiency can be obtained as long as the allowable error E is approximately in a range of no less than 60(%), obviously if E≤20(%), it is considered that a further effect can be obtained, and if E≤10(%), it is considered that an even further effect can be obtained.

AlGaN is a compound of Al (atomic number 13), Ga (atomic number 31) and N (atomic number 7). A lattice constant thereof decreases as the composition ratio of Al, which is smaller in atomic size than Ga, increases. In a compound semiconductor, there is a tendency for an energy band gap Eg to be greater when the lattice constant is smaller and thus as the composition ratio X increases, the energy band gap Eg increases and a corresponding wavelength λ decreases.

The minimum value $X_{MIN(2)}$ of the composition ratio X in the second region 12 satisfies the following relationship.

$$0.3\leq X_{MIN(2)}\leq 0.65$$

When the average value of the Al composition ratio X in the second region 12 is no less than 0.3, the energy band gap Eg of the second region 12 is large and the quantum efficiency is significantly improved because light of short wavelength (no more than 280 nm) is readily transmitted through the second region 12. Also, the Al composition ratio X cannot be increased beyond a limit in terms of manufacture and the composition ratio X is preferably no more than 0.65. This is because crystallinity is significantly degraded when the Al composition ratio X exceeds the upper limit.

Also, the thickness D1 of the first region 11 is preferably no more than 100 nm. In this case, the quantum efficiency can be increased. The thickness of a general GaN photocathode is approximately 100 nm and it is thus considered that sufficient photoelectric conversion will be performed and electron emission will be performed if at least D1 is no more than 100 nm. Also, the thickness D1 is preferably no more than 235 nm because electron emission into vacuum decreases significantly when the electron diffusion length of 235 nm is exceeded. As described above, if D1 (117.5 nm) is one-half of the total thickness D and the allowable error is 60%, the total thickness D is substantially no more than 235 nm, and in a case where an allowable limit is DM+D2=47(=117.5×0.4) nm, it is necessary for D1=188(=235−47) nm or less. Similarly, if the allowable error is 20%, it is necessary for D1=141 (=235−117.5×0.8) nm or less. As mentioned above, the thickness D1 is preferably no more than 235 nm, more preferably no more than 188 nm, yet more preferably no more than 141 nm, and optimally no more than 100 nm.

FIG. 33A to FIG. 33D shows, together with the compound semiconductor layer, graphs of relationships of the position x in the thickness direction of the compound semiconductor layer 1 and the Al composition ratio X according to type. FIG. 33A is a diagram of a compound semiconductor layer and FIG. 33B, FIG. 33C, and FIG. 33D are graphs of relationships of a position x in a thickness direction of the compound semiconductor layer and an Al composition ratio X.

With the semiconductor photocathode of Type 1 (comparative example), the Al composition ratio X is zero in all regions 11, 1M, and 12.

With the semiconductor photocathode of Type 2 (Example 1), the Al composition ratio X in the first region 11 (positions xb to xc) is zero. The Al composition ratio X in the intermediate region 1M (positions xa to xb) decreases monotonously with respect to the position x (a slope of change of X with respect to x is (−a)). a is a fixed value. The Al composition ratios X in the second region 12 (positions 0 to xa) decreases monotonously with respect to the position x (a slope of change of X with respect to x is (−a)). a is a fixed value.

In the second region 12, the maximum value of the composition ratio X is Xi and the minimum value is Xj, and in the intermediate region 1M, the maximum value of the composition ratio X is Xj and the minimum value is 0. The maximum values and the minimum values are obtained at the positions of the opposite interfaces of the respective layers. With Type 2, among the present examples, Xi and Xj are set as Xi=0.3 and Xj=0.5.

With the semiconductor photocathode of Type 3 (Example 2), the Al composition ratio X in the first region 11 (positions xb to xc) is zero. The Al composition ratio X in the intermediate region 1M (positions xa to xb) decreases monotonously with respect to the position x (a slope of change of X with respect to x is (−2×a)). a is a fixed value. The Al composition ratio X in the second region 12 is independent of the position x and is of a fixed value (X2). In the second region 12, the maximum value or minimum value X2 of the composition ratio X is the maximum value X2 of the composition ratio X in the intermediate region 1M. With Type 3, among the present examples, X2 is set as X2=0.3.

FIG. 34A to FIG. 34D shows, together with the compound semiconductor layer, graphs of relationships of the position x in the thickness direction of the compound semiconductor layer and an impurity (Mg) concentration according to type. FIG. 34A is a diagram of a compound semiconductor layer and FIG. 34B, FIG. 34C, and FIG. 34D are graphs of relationships of the position x in a thickness direction of the compound semiconductor layer and an impurity (Mg) concentration.

With the semiconductor photocathode of Type 1 (comparative example), the Mg concentration is fixed (=Cj) in all regions 11, 1M, and 12.

With the semiconductor photocathode of Type 2 (Example 1), the Mg concentration is fixed (=Cj) in the first region 11 (Example 1-1). However, the Mg concentration may be increased toward the glass substrate side to a concentration Ci in accordance with the increase in the Al composition ratio X toward the glass substrate side (Example 1-2). In other words, a p-type impurity concentration C is proportional to the function g(x), which is a monotonously decreasing function with respect to the position x. By changing the impurity concentration in the same manner as the change of composition ratio, an effect of compensation of a decrease in carrier concentration due to an increase in Al composition is anticipated.

With the semiconductor photocathode of Type 3 (Example 2), the Mg concentration is fixed (=Cj) in the first region 11. The Mg concentration is increased toward the glass substrate side to a concentration Ck in accordance with the increase in the Al composition ratio X toward the glass substrate side. In other words, the p-type impurity concentration C is of a fixed value in the second region 12 and is proportional to the function g(x), which is a monotonously decreasing function with respect to the position x, in the intermediate region 1M. By changing the impurity concentration in the same manner as the change of composition ratio, the effect of compensation of a decrease in carrier concentration due to an increase in Al composition is anticipated.

The values of the impurity concentrations Cj, Ci, and Ck are respectively as follows.

$$Cj=7\times10^{18}\ \mathrm{cm}^{-3}$$

$$Ci=2\times10^{18}\ \mathrm{cm}^{-3}$$

$$Ck=2\times10^{18}\ \mathrm{cm}^{-3}$$

Also from standpoints of realizing a negative electron affinity (NEA) and lowering of crystallinity due to excessive doping, preferable ranges of the impurity concentrations Cj, Ci, and Ck are respectively as follows.

$$Cj=1\times10^{18}\ \mathrm{cm}^{-3}\text{ or more, }3\times10^{19}\ \mathrm{cm}^{-3}\text{ or less}$$

$$Ci=3\times10^{18}\ \mathrm{cm}^{-3}\text{ or more, }5\times10^{19}\ \mathrm{cm}^{-3}\text{ or less}$$

$$Ck=3\times10^{18}\ \mathrm{cm}^{-3}\text{ or more, }5\times10^{19}\ \mathrm{cm}^{-3}\text{ or less}$$

FIG. 35A, FIG. 35B and FIG. 35C each shows diagrams for explaining a method for manufacturing a semiconductor photocathode.

First, an AlGaN crystal before bonding is manufactured on an Si substrate (FIG. 35A), the Si substrate and unnecessary semiconductor layers are then removed by polishing to prepare a compound semiconductor layer 1, and lastly, the compound semiconductor layer 1 is bonded to a glass substrate 3 (FIG. 35B) and a portion is removed (FIG. 35C). This process shall now be described in detail.

First, as shown in FIG. 35A, a 5-inch n-type (111) Si substrate is prepared. Although the compound semiconductor layer 1 with Mg added is then grown on the Si substrate by an MOVPE (metal-organic vapor phase epitaxy) method, before growing the compound semiconductor layer 1, a buffer layer 22 for stress relaxation and an undoped GaN layer (template layer) 23 are successively grown on the Si substrate 21 in advance. The buffer layer 22 is 1200 nm in thickness and has a superlattice structure made of 40 pairs of AlN/GaN, and the undoped template layer 23 has a thickness of 650 nm. The compound semiconductor layer 1 ($Al_xGa_{1-x}N$) that is free of cracks and stress can thereby be formed on the Si substrate 21.

In the MOVPE method, trimethylgallium (TMGa) may be used as a raw material of Ga, trimethylaluminum (TMA) may be used as a raw material of Al, ammonia ($NH_3$) may be used as a raw material of N, and by controlling the ratio of these raw materials, the composition ratio X in $Al_xGa_{1-x}N$ can be adjusted. Hydrogen gas is used as a carrier gas. A growth temperature of the buffer layer 22 with the AlN/GaN superlattice structure and the GaN template layer 23 is 1050° C. A pressure inside a chamber during growth of the buffer layer 22 is $1.3\times10^3$ Pa and the pressure inside the chamber during growth of the template layer 23 is $1.3\times10^3$ to $1.0\times10^5$ Pa. In a region of 200 nm from a surface of the compound semiconductor layer 1 before removal by etching, Mg is added using ($Cp_2Mg$: bis(cyclopentadienyl)magnesium).

Also, with regard to manufacture of the buffer layer 22, a substrate temperature is set to 1120° C. and thereafter a flow rate of a TMA gas, in other words, a supply rate of Al is set to approximately 63 μmol/minute and a flow rate of an $NH_3$ gas, in other words, a supply rate of $NH_3$ is set to approximately 0.14 mol/minute to form the AlN layer, and then after stopping the supply of the TMA gas with the substrate temperature being set to 1120° C., a TMG gas and the $NH_3$ gas are supplied into the reaction chamber to form a second layer made of GaN on an upper surface of a first layer made of AlN that is formed on one principal surface of the substrate 21.

In forming the template layer 23, the TMG gas and the $NH_3$ gas are supplied into the reaction chamber to form GaN on an upper surface of the buffer layer 22. After setting the substrate temperature to 1050° C., a flow rate of the TMG gas, in other words, a supply rate of Ga is set to approximately 4.3 μmol/minute and the flow rate of the $NH_3$ gas, in other words, the supply rate of $NH_3$ is set to approximately 53.6 mmol/minute.

The substrate temperature is set to 1050° C., the TMG gas, ammonia gas, and $Cp_2Mg$ gas are supplied into the reaction chamber or, the TMA gas is supplied as the Al raw material to form a p-type GaN layer or a p-type AlGaN layer on the template layer 23. The flow rate of the TMG gas is set to approximately 4.3 μmol/minute and the flow rate of the TMA gas is adjusted in accordance with a change of the Al composition. For example, if the composition ratio X is to be set to 0.30, the flow rate of the TMA gas is approximately 0.41 μmol/minute. The flow rate of the $Cp_2Mg$ gas is set to approximately 0.24 μmol/minute when the Al composition is to be 0.3 and to approximately 0.12 μmol/minute when the Al composition is to be 0. The p-type impurity concentration in the compound semiconductor layer 1 is approximately 0.1 to $3\times10^{18}$ $cm^{-3}$. With the above manufacturing method, crystal orientations of the respective layers 23 and 1 can be aligned with the crystal orientation of the buffer layer 22.

In the structure of the comparative example (Type 1), an initial thickness of the compound semiconductor layer 1 is 200 nm, in the structure of Example 1 (Type 2), a region up to 50 nm from the surface is a graded AlGaN in which the Al composition changes gradually, and in the structure of Example 2 (Type 3), a region up to 25 nm from the surface is AlGaN with the Al composition being fixed and a region from 25 nm to 50 nm from the surface is a graded AlGaN layer in which the Al composition changes gradually. Although the initial thickness of the compound semiconductor layer 1 is 200 nm, a region corresponding to substantially half of the total thickness is removed by etching.

On an exposed surface of the compound semiconductor layer 1 after growth, the adhesive layer 2, made of $SiO_2$ and having a thickness of several hundred nm, is formed by a CVD (chemical vapor deposition) method.

Thereafter as shown in FIG. 35B, the glass substrate 3 is bonded by thermocompression bonding via the adhesive layer 2 onto the compound semiconductor layer 1. A temperature during the compression bonding is 650° C.

Thereafter as shown in FIG. 35C, the Si substrate 21 is removed and subsequently, the buffer layer 22, the template layer 23, and a portion of the compound semiconductor layer 1 are removed. The Si substrate 21 is removed using a mixed liquid of hydrofluoric acid, nitric acid, and acetic acid. In this process, the buffer layer 22 also functions as an etching stopping layer. The buffer layer 22, the template layer 23, and a region of half of the thickness (100 nm) of the compound semiconductor layer 1 are removed by a mixed liquid of phosphoric acid and water. The compound semiconductor layer 1 is thereby made approximately 100 nm in thickness. In the present example, the total thickness D can be changed from 68 nm to 96 nm by changing the amount removed from the compound semiconductor layer.

As described above, the above method for manufacturing the semiconductor photocathode includes the step of successively depositing the GaN buffer layer 22, the GaN template layer 23, the compound semiconductor layer 1, and the $SiO_2$ layer 2 on the supporting substrate 21, the step of bonding the glass substrate 3 onto the compound semiconductor layer 1 via the $SiO_2$ layer 2, and a step of successively removing the supporting substrate 21, the buffer layer 22, the template layer 23, and a portion of the compound semiconductor layer 1 and making the remaining region of the compound semiconductor layer 1 be the $Al_XGa_{1-X}N$ layer (11, 1M, and 12). With this manufacturing method, the semiconductor photocathode described above can be manufactured readily.

The semiconductor photocathode described above was used to prepare the image intensifier tube.

In manufacturing the image intensifier tube, first, a glass substrate (faceplate) with the compound semiconductor layer 1 bonded thereto, an enclosure tube with an MCP (microchannel plate) built in, a phosphor output plate, and a Cs metal source are disposed in a vacuum chamber. Thereafter, air inside the vacuum chamber is evacuated and baking (heating) of the vacuum chamber is performed to increase a vacuum degree inside the vacuum chamber. A vacuum degree of $10^{-7}$ Pa was thereby attained after cooling of the vacuum chamber. Further, an electron beam is irradiated onto the MCP and the phosphor output plate to remove gases trapped in interiors of these components. Thereafter, the photoelectron emission surface of the glass substrate is cleaned by heating and in continuation, the Cs metal source is heated to make Cs and oxygen become adsorbed on the photoelectron emission surface (exposed surface of the compound semiconductor layer 1) to thereby activate and decrease an electron affinity of the photoelectron emission surface. Lastly, after using an indium sealing material to mount the glass substrate and the phosphor output plate on opposite open ends of the enclosure tube and seal the enclosure tube, the tube is taken out from inside vacuum chamber.

Semiconductor photocathodes of above Type 1 to Type 3 were manufactured in the case of that the total thickness D of the compound semiconductor layer 1 was set to be in a range between 68 nm to 78 nm, the thickness D was set to be 81 nm, and the thickness D was set be 96 nm.

FIG. 36 is a diagram showing a list of conditions for samples of each type.

A sample No. (1-1) is a Type 1 (in which the compound semiconductor layer 1 includes a GaN layer only) semiconductor photocathode with D=D1=78 nm. A sample No. (1-2) is a Type 1 semiconductor photocathode with D=D1=81 nm. A sample No. (1-3) is a Type 1 semiconductor photocathode with D=D1=96 nm. The Al composition ratio X=0, and therefore a composition gradient of X is also 0%/nm.

A sample No. (2-1) is a Type 2 (in which the second region and the intermediate region of the compound semiconductor layer 1 include a graded AlGaN layer) semiconductor photocathode with D=68 nm, D1=18 nm, DM=25 nm, D2=25 nm. A sample No. (2-2) is a Type 2 semiconductor photocathode with D=81 nm, D1=31 nm, DM=25 nm, D2=25 nm. A sample No. (2-3) is a Type 2 semiconductor photocathode with D=96 nm, D1=46 nm, DM=25 nm, D2=25 nm. The Al composition ratio X is linearly changed in a range from 0 to 0.3 along the direction of thickness over the regions DM and D2, and therefore the composition gradient of X is 0.6%/nm.

A sample No. (3-1) is a Type 3 (in which the Al composition in the second region of the compound semiconductor layer 1 is constant and the intermediate region includes a graded AlGaN layer) semiconductor photocathode with D=77 nm, D1=27 nm, DM=25 nm, D2=25 nm. A sample No. (3-2) is a Type 3 semiconductor photocathode with D=81 nm, D1=31 nm, DM=25 nm, D2=25 nm. A sample No. (3-3) is a Type 3 semiconductor photocathode with D=96 nm, D1=46 nm, DM=25 nm, D2=25 nm. The composition ratio X of the second region D2 is a constant value of 0.3 and the Al composition ratio X is linearly changed in a range from 0 to 0.3 along the direction of thickness in the intermediate region DM; therefore, the composition gradient of X is 1.2%/nm.

Figure 37:
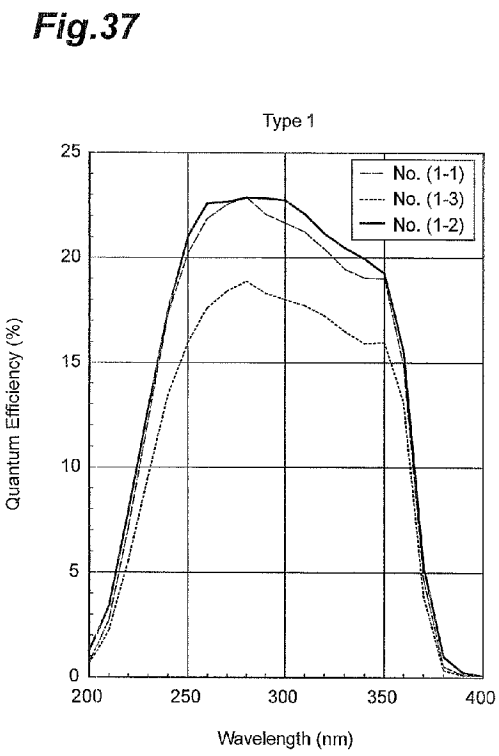
FIG. 37 is a graph showing a relationship between the wavelength (nm) and the quantum efficiency (%) in a Type 1 sample in the transmission mode.

FIG. 37 is a graph showing a relationship between the wavelength (nm) and the quantum efficiency (%) in a Type 1 sample in the transmission mode. Data in a case where the thickness D of the compound semiconductor layer 1 is 78 nm (the sample No. (1-1)), 81 nm (the sample No. (1-2)), and 96 nm (the sample No. (1-3)) is shown. It is known from the data that the quantum efficiency does not become higher as the thickness D is increased. More specifically, the quantum efficiency is higher when the thickness D=81 nm compared with the case where the thickness D=78 nm, however, the quantum efficiency decreases when the thickness D=96 nm.

To paraphrase this, it is considered that the quantum efficiency increased compared with the case where the thickness D=78 nm because the region contributing to photoelectric conversion became large when the thickness D had become large (D=81 nm); and the quantum efficiency decreased because the electron non-emittable region on the glass substrate side became large when the thickness D became larger (D=96).

Figure 38A:
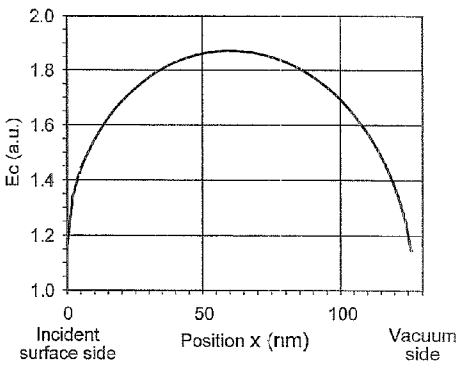
FIG. 38A is a graph showing a relationship between a position x (nm) of a Type 1 sample and the energy level (a.u.) in the lower end of the conduction band.
Figure 38B:
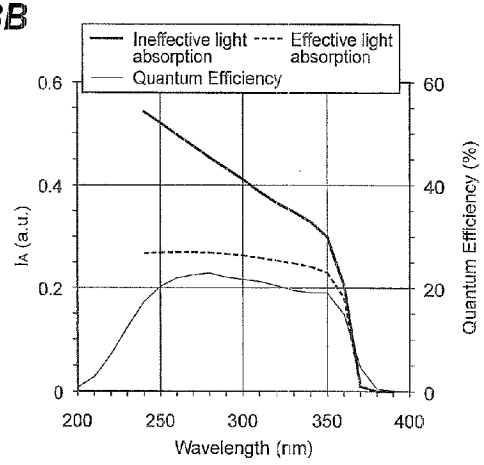
FIG. 38B is a graph showing a relationship among the wavelength (nm), the light absorption amount (a.u.), and the quantum efficiency (%) in the transmission mode.

FIG. 38A is a graph showing a relationship between a position x (nm) of a Type 1 sample and the energy level Ec (a.u.) in the lower end of the conduction band; and FIG. 38B is a graph showing a relationship among the wavelength (nm), the light absorption amount $I_A$ (a.u.), and the quantum efficiency (%) in the transmission mode.

In FIG. 38A, a case where the thickness D=140 nm is shown. As illustrated in FIG. 38A, a peak of the energy level in the lower end of the conduction band is located at the position x, which is present at a substantially ½ of the thickness D. The peak position xp is about 60 nm.

In addition, in FIG. 38B, a case where D=100 nm and the peak position xp is 50 nm is shown, in which the increase in ineffective light absorption in the region in the short wavelength (wavelength of 350 nm or less) side is shown. This ineffective absorption is absorption in the electron non-emittable region on the glass substrate side.

Figure 39:
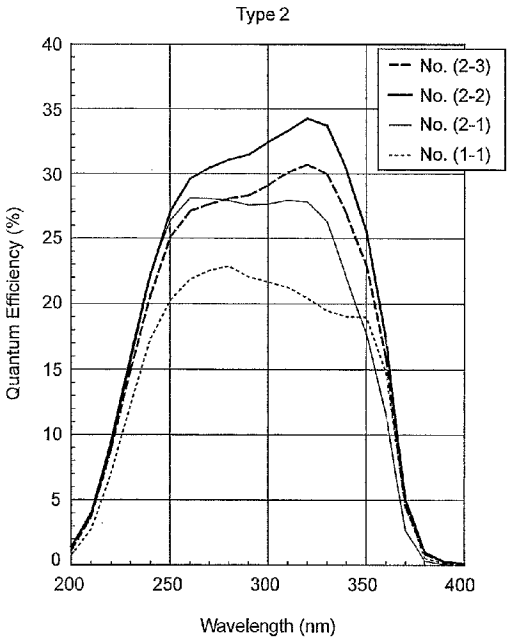
FIG. 39 is a graph showing a relationship between the wavelength (nm) and the quantum efficiency (%) for a Type 2 sample.

FIG. 39 is a graph showing a relationship between the wavelength (nm) and the quantum efficiency (%) for a Type 2 sample in the transmission mode. Data in a case where the thickness D of the compound semiconductor layer 1 is 68 nm (the sample No. (2-1)), 81 nm (the sample No. (2-2)), and 96 nm (the sample No. (2-3)) is shown. Data of the Type 1 in which the compound semiconductor layer 1 includes GaN only (No. (1-1)) is shown for comparison. In either case (D1=18 nm, 31 nm, 46 nm), the quantum efficiency is higher than that in the case of the Type 1. More specifically, in the case of the Type 2, in a case where the thickness D1 is 18 nm or more, the quantum efficiency becomes higher than that in the comparative example. Note that in order to achieve a high quantum efficiency, the total thickness D is preferably 68 nm or more and 96 nm or less.

Figure 40A:
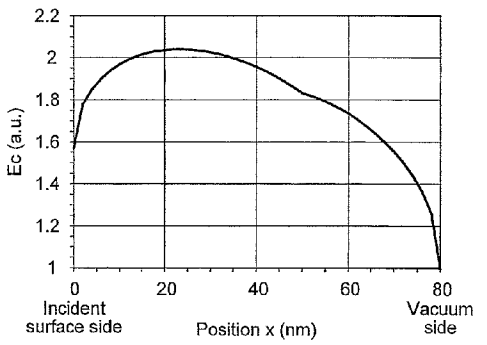
FIG. 40A is a graph showing a relationship between a position x (nm) of a Type 2 sample and the energy level Ec (a.u.) in the lower end of the conduction band.
Figure 40B:
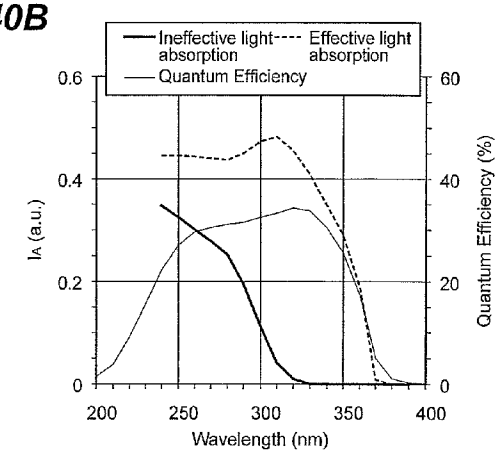
FIG. 40B is a graph showing a relationship among the wavelength (nm), the light absorption amount $I_A$ (a.u.), and the quantum efficiency (%) in the transmission mode.

FIG. 40A is a graph showing a relationship between a position x (nm) of a Type 2 sample and the energy level Ec (a.u.) in the lower end of the conduction band; and FIG. 40B is a graph showing a relationship among the wavelength (nm), the light absorption amount (a.u.), and the quantum efficiency (%) in the transmission mode.

In FIG. 40A, a case where the thickness D=81 nm (No. (2-2)) is shown. As illustrated in FIG. 40A, a peak of the energy level in the lower end of the conduction band is located at a position closer to the glass substrate side than the position x, which is located at a substantially ½ of the thickness D. The peak position xp is about 20 nm.

In addition, in FIG. 40B, a case where D=100 nm and the peak position xp is 25 nm (D1=50 nm, D2=25 nm, DM=25 nm) is shown, in which the ineffective light absorption in a short wavelength band (wavelength ranging from 300 to 370 nm) has considerably decreased and effective light absorption has increased compared with the case of the Type 1. This is because the peak position of the energy level has moved and the transmissivity on the glass substrate side has increased.

Figure 41:
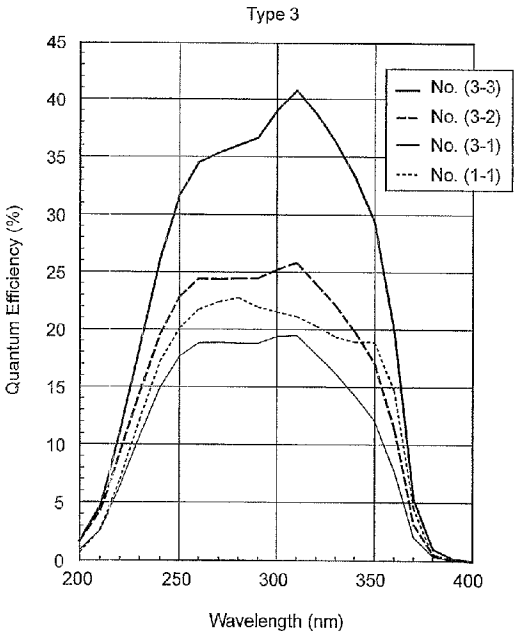
FIG. 41 is a graph showing a relationship between the wavelength (nm) and the quantum efficiency (%) for a Type 3 sample.

FIG. 41 is a graph showing a relationship between the wavelength (nm) and the quantum efficiency (%) for a Type 3 sample in the transmission mode. Data in a case where the thickness D of the compound semiconductor layer 1 is 77 nm (the sample No. (3-1)), 81 nm (the sample No. (3-2)), and 96 nm (the sample No. (3-3)) is shown. Data of the Type 1 in which the compound semiconductor layer 1 includes GaN only (No. (1-1)) is shown for comparison. Except where D1=27 nm, the quantum efficiency when D1=31 nm, 46 nm is higher than the case of the Type 1. More specifically, in the case of the Type 3, in a case where the thickness D1 is 31 nm or more, the quantum efficiency becomes higher than that in the comparative example. Note that in order to achieve a high quantum efficiency, the total thickness D is preferably 77 nm or more and 96 nm or less. This is because the quantum efficiency is considered to be able to be increased because the region on the glass substrate side, which becomes the shadow of the peak in the lower end of the valence band, becomes small in these ranges according to the above energy band gap principle.

Note that the reason for the quantum efficiency for the sample No. (3-1) lower than that of the comparative example will be considered. In the sample No. (2-1) with the thickness D1, the quantum efficiency is higher compared with the comparative example. This can be considered to mean that a first region D1 is required to be thicker in a case where the Al composition includes a constant region, in other words, in a case where the integral value of the content of Al in the direction of thickness is high, than that in a case where the Al composition does not include a constant region.

Figure 42A:
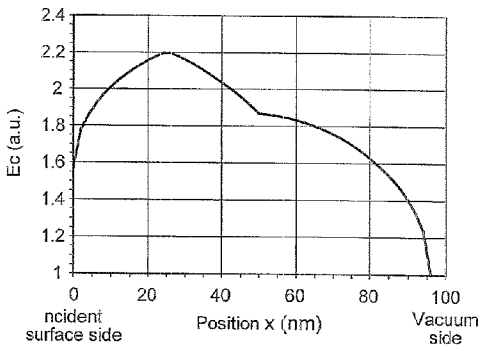
FIG. 42A is a graph showing a relationship between a position x (nm) of a Type 3 sample and the energy level Ec (a.u.) in the lower end of the conduction band.
Figure 42B:
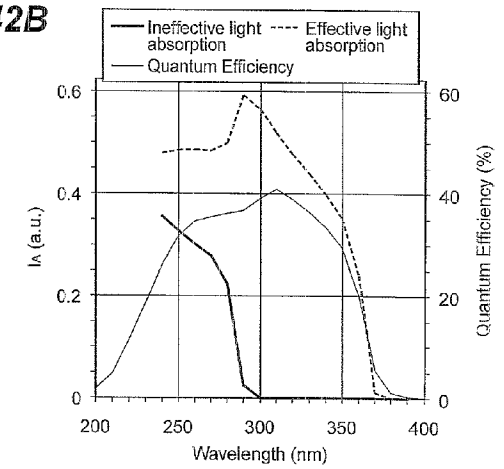
FIG. 42B is a graph showing a relationship among the wavelength (nm), the light absorption amount $I_A$ (a.u.), and the quantum efficiency (%).

FIG. 42A is a graph showing a relationship between a position x (nm) of a Type 3 sample and the energy level Ec (a.u.) in the lower end of the conduction band; and FIG. 42B is a graph showing a relationship among the wavelength (nm), the light absorption amount $I_A$ (a.u.), and the quantum efficiency (%) in the transmission mode.

In FIG. 42A, a case where the thickness D=96 nm (No. (3-3)) is shown. As illustrated in FIG. 42A, a peak of the energy level in the lower end of the conduction band is located at a position closer to the glass substrate side than the position x, which is present at a substantially ½ of the thickness D. The peak position xp is about 25 nm.

In addition, in FIG. 42B, a case where D=100 nm and the peak position xp is 25 nm (D1=50 nm, D2=25 nm, DM=25 nm) is shown, in which the ineffective light absorption in the short wavelength band (the wavelength ranging from 280 to 380 nm) has considerably decreased and effective light absorption has increased compared with the case of the Type 1. This is because the peak position of the energy level has moved and the transmissivity on the glass substrate side has increased.

Differently from the case of the Type 1, the peak position xp of the energy band has moved in the above-described manner in the cases of the Type 2 and the Type 3. The level of the conduction band on the light incidence side has been raised due to the AlGaN layer in which the Al composition ration continuously changes. As a result, the thickness not contributing to the photoelectric emission becomes about ¼ or less of the total thickness D and becomes the half of the thickness of the Type 1 not contributing to the photoelectric emission. This means that the light absorption not contributing to the photoelectric emission greatly decreases.

Because the region not contributing to the photoelectric emission is an $Al_{0.3}GaN$ layer with a constant Al composition ratio or an AlGaN layer with an Al composition gradually decreasing from 0.3, the great energy band gap Eg and the light spectral transmission higher than that of GaN according to the energy band gap Eg are also considered to contribute to the increase in the quantum efficiency.

Figure 43A:
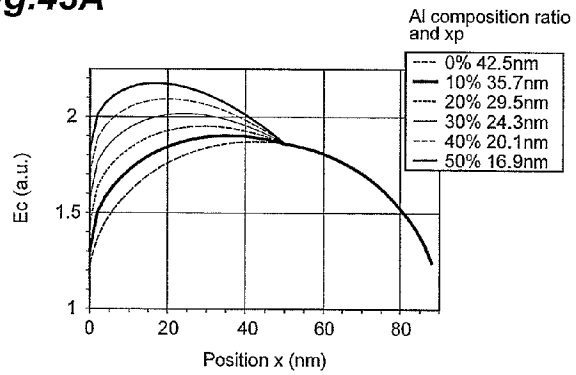
FIGS. 43A and 43B show graphs showing a relationship between a position x of the compound semiconductor layer and an energy level Ec (a.u.) of the lower end of the conduction band (Type 2 (FIG. 43A), Type 3 (FIG. 43B).
Figure 43B:
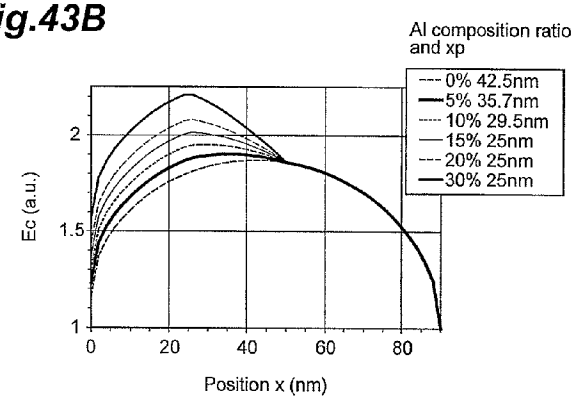

FIGS. 43A and 43B show graphs showing a relationship between a position x of the compound semiconductor layer and an energy level Ec (a.u.) of the lower end of the conduction band (Type 2 (FIG. 43A), Type 3 (FIG. 43B).

FIG. 43A is a graph showing a case where D=90 nm and the thickness of the graded AlGaN layer (DM+D2) is 50 nm for the Type 2 and the Al composition ratio X is linearly changed from 0 to 50% in this region. It is known that the peak position xp moves toward the light incidence surface side in order of 42.5, 35, 29.5, 24.3, 20.1 and 16.9 nm as the Al composition ratio X increases in order of 0, 10, 20, 30, 40, and 50%.

FIG. 43B is a graph showing a case where D=90 nm, the thickness D2 of the AlGaN layer with a constant composition=25 nm, and the thickness DM of the graded AlGaN layer=25 nm for the Type 3 and the Al composition ratio X is linearly changed from 0 to 30% in this region. It is known that the peak position xp moves toward the light incidence surface side in order of 42.5, 35.7, 29.5, 25, 25, and 25 nm as the Al composition ratio X increases in order of 0, 5, 10, 15, 20, and 30% and that the movement of xp stops at 25 nm when X=15% or more.

With X being 15% or more, an effect of reducing a production error of the peak position xp can be achieved. It is preferable if the peak position xp be close to the incidence surface side, and therefore, the peak position xp is preferably more than 0 nm and 25 nm or less. In this case, the sensitivity to ultraviolet (UV) light can be significantly improved due to the effect of curvature of the band and the effect of the improved transmissivity. Note that if the composition ratio X exceeds a production limit of 65%, the crystallinity considerably degrades, which is not preferable, and if the rate of change of the composition ratio in the thickness direction becomes excessively great, the crystallinity degrades, which is not preferable. From these viewpoints, X is preferably 52% or less, more preferably 46% or less; the rate of change per unit length of X is preferably 2.0%/nm or less and more preferably 1.5%/nm or less.

Figure 44A:
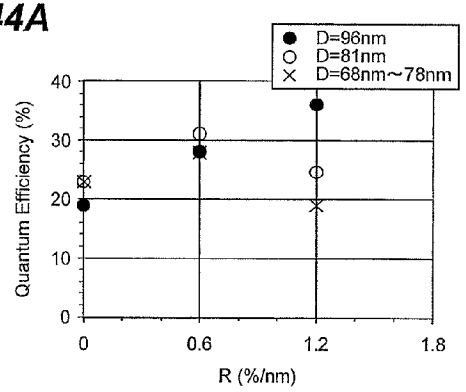
FIG. 44A is a graph showing a relationship between an Al composition gradient (%/nm) in the compound semiconductor layer and a quantum efficiency (%)
Figure 44B:
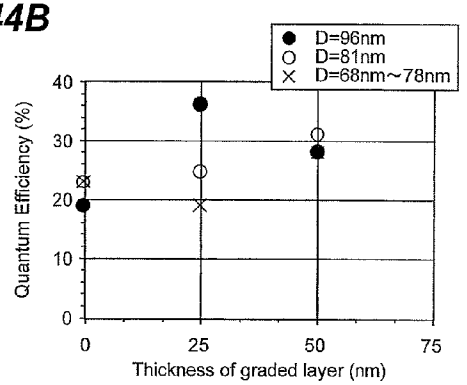
FIG. 44B is a graph showing a relationship between the thickness of an Al composition inclined layer (nm) in the compound semiconductor layer and the quantum efficiency (%).

FIG. 44A is a graph showing a relationship between an Al composition gradient R (%/nm) in the compound semiconductor layer and a quantum efficiency (%) in the transmission mode; and FIG. 44B is a graph showing a relationship between the thickness of an Al inclined layer (nm) in the compound semiconductor layer and the quantum efficiency (%) in the transmission mode.

Note that the quantum efficiency in these drawings is a value at the wavelength of 280 nm. In these drawings, data of the above samples No. (1-1) to (3-3) is shown. In FIG. 44A, the composition gradient R of 0 corresponds to a case of the Type 1, the composition gradient R of 0.6%/nm corresponds to a case of the Type 2, and the composition gradient R of 1.2%/nm corresponds to a case of the Type 3. In FIG. 44B, the inclined layer is 0 nm in the Type 1, the thickness DM+D2=50 nm in the Type 2, and the thickness DM=25 nm in the Type 3.

In the Type 2 (the composition gradient R: 0.6%/nm), the quantum efficiency when D=81 nm is high, and in the Type 3 (the composition gradient R: 1.2%/nm), the quantum efficiency when D=96 nm is high. In the Type 3, the quantum efficiency becomes higher as D increases. In a case where the thickness of the inclined layer is 50 nm or less, when the thickness of the inclined layer is 25 nm, the quantum efficiency is 36.1%.

More specifically, in the above Type 1, in the sample No. (1-1), the quantum efficiency is 22.9%, in the sample No. (1-2), the quantum efficiency is 22.9%, and in the sample No. (1-3), the quantum efficiency is 18.9%.

In the Type 2, in the sample No. (2-1), the quantum efficiency is 27.9%, in the sample No. (2-2), the quantum efficiency is 31.1%, and in the sample No. (2-3), the quantum efficiency is 28.1%.

In the Type 3, in the sample No. (3-1), the quantum efficiency is 18.9%, in the sample No. (3-2), the quantum efficiency is 24.6%, and in the sample No. (3-3), the quantum efficiency is 36.1%.

By observing the above graphs (FIG. 39 (Type 2) and FIG. 41 (Type 3)), because the level of improvement of the sensitivity is less for the Type 2 compared with the Type 3, it is considered that the peak position xp of the Type 2 is present at a location more distant than 25 nm from the interface on the incident side. In addition, as shown in FIGS. 40B and 42B, almost no light absorption not contributing to the photoelectric emission for the Type 2 and the Type 3 occurs in the wavelength longer than 300 nm, which corresponds to the great improvement of the quantum efficiency of the Type 2 and the Type 3 from 290 nm to a longer wavelength side in FIGS. 39 and 41. As described above, it is obvious that the control of the shape of the conduction band with the inclined composition layer in which the Al composition is continuously changed has been reflected on the spectral response characteristic. In addition, for the Type 1, the quantum efficiency as low as 25% or so at the maximum was achieved, but for the Type 3, the quantum efficiency as high as 40.9% at the maximum was able to be achieved. It is considered that this was achieved because the light absorption region not contributing to the photoelectric emission was reduced in half and because the light transmissivity was increased by increasing the band gap in the region not contributing to the photoelectric emission.

Figure 46:
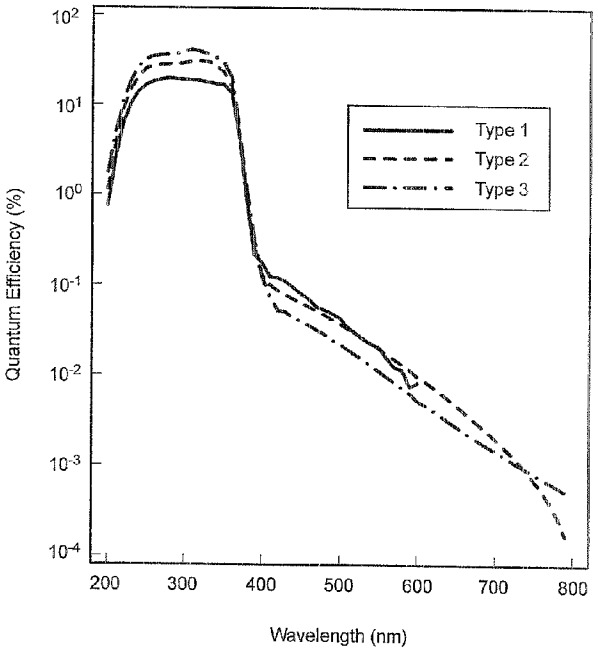
FIG. 46 is a graph showing a relationship between a wavelength (nm) in the Type 1 to Type 3 samples and the quantum efficiency (%) in a wide range (200 to 800 nm).

FIG. 46 is a graph showing a relationship between a wavelength (nm) in the Type 1 to Type 3 samples (No. (1-2), No. (2-3), and No. (3-3)) and the quantum efficiency (%) in the transmission mode in a wide range (200 to 800 nm).

In a case of each sample, the quantum efficiency in the wavelength of about 400 nm or less has increased but the quantum efficiency in the wavelength of about 400 nm or more is low. Furthermore, in the wavelength of about 400 nm or more, the quantum efficiency of the photocathode of the Type 1 is higher than the quantum efficiency of the photocathode of the other types, i.e., the Type 2 and the Type 3.

Note that the sensitivity of the photocathode on the short wavelength side is limited by the transmissivity of the face plate. The cutoff wavelength is imparted by the energy band gap of GaN and is 365 nm. According to the graph of FIG. 46, the quantum efficiency abruptly decreases in the wavelength of 365 nm or more. The sensitivity on the side of the wavelength longer than the cutoff wavelength depends on the characteristic of the alkali metal-containing layer 4 (Cs—O). The maximum quantum efficiency for the Type 1 is 22.9% in relation to light (UV light) of a wavelength of 280 nm, that for the Type 2 is 30.7% in relation to light (UV light) of a wavelength of 320 nm, and that for the Type 3 is 40.9% in relation to light (UV light) of a wavelength of 310 nm. As described above, the quantum efficiency has remarkably improved for the Type 2 and the Type 3.

Furthermore, in the above example, GaN is used in the first region 11, an effect of improving the quantum efficiency to some extent can be achieved because it is enabled to adjust the energy peak position in the lower end of the conduction band according to an analysis of the energy band gap if the GaN contains Al to become AlGaN. In addition, Mg is added as a p type impurity, however, the loads of various semiconductor layers can be freely adjusted in a range not greatly affecting the energy band structure. For example, Mg may be added to a non-doped GaN layer, which is utilized at the time of production.

As a substrate 21 (FIG. 35A) utilized at the time of production, Si is preferable from the viewpoint of obtaining a high quality GaN crystal, and various types of substrates can be used, such as a sapphire substrate, an oxidized compound substrate, a compound semiconductor substrate, an SiC substrate, or the like. In addition, the content of impurities in an Si substrate utilized at the time of production is about $5\times10^{18}$ $cm^{-3}$ to $5\times10^{19}$ $cm^{-3}$, and the resistivity of the substrate is about 0.0001 Ω·cm to 0.01 Ω·cm. As an n type impurity, As (arsenic) can be used.

As a semiconductor super lattice structure constituting the buffer layer 22 (FIG. 35A) used at the time of production, a structure including AlN layers and GaN layers alternately laminated together is utilized, and an AlGaN layer can be used instead of the AlN layer. The loads of impurities to the super lattice structure are arbitrary and any of p type, n type, and non-doped impurities can be used, and the non-doped type is preferable from the viewpoint of not needlessly bringing about a cause for degrading the crystallinity. The thickness of the first layer (AlN) a included in a buffer layer 12 is preferably $5\times10^{-4}$ μm to $500\times10^{-4}$ μm, i.e., 0.5 to 50 nm, and the thickness of the second layer (GaN) is preferably $5\times10^{-4}$ μm to $5{,}000\times10^{-4}$ μm, i.e., 0.5 to 500 nm. In a composite layer, which is included in the buffer layer 22 and includes a plurality of first layers and a plurality of second layers alternately laminated together, it is not necessary to set the same thickness for each layer. By using the buffer layer 22 with this configuration, a semiconductor function layer with satisfactory flatness and crystallinity can be obtained on an Si substrate. In the above example, the thickness of the first layer (AlN) is 5 nm and the thickness of the second layer (GaN) is 25 nm. The thickness of a buffer layer 21 is 1,200 nm, however, the thickness of the buffer layer 21 may be 1,800 nm by increasing the number of layers.

Note that the above composition ratio X is given as a function of the position x (X=g(x)), and the following function is preferable as g(x). Note that X1 represents a maximum value (or an average value) of the composition ratio X in the first region 11 and X2 represents a minimum value (or an average value) of the composition ratio X in the second region 12. In addition, as described above, the total thickness D of the compound semiconductor layer 1, the thickness DM of the intermediate region 1M, the thickness D2 of the second region 12, and an allowable error E (≤60) are expressed as (D2+DM)×(100±E) %=D/2.

(Case 1: refer to Type 2)

In the region 0≤x<D2+DM:

X=g(x)=(X2−X1)×(1−x/(D2+DM))+X1 is satisfied, and in the region D2+DM≤x<D2+DM+D1:

X=g(x)=X1 or

X=g(x)≤X1 is satisfied.

(Case 2: refer to Type 3)

In the region 0≤x<D2:

X=g(x)=X2, or

X=g(x)≥X2 is satisfied, in the region D2≤x<D2+DM:

X=g(x)=−(X2−X1)×(x−D2)/DM+X2 is satisfied, and in the region D2+DM≤x<D2+DM+D1:

X=g(x)=X1 or

X=g(x)≤X1 is satisfied.

(Case 3: refer to Type 3)

In the region 0≤x<D2:

X=g(x)=X2, or

X=g(x)≥X2 is satisfied, in the region D2≤x<D2+DM:

X=g(x)=(X2−X1)×$(e^{-x/(D2+DM)}-e^{-1})/(1-e^{-1})$+X1 is satisfied, and in the region D2+DM≤x<D2+DM+D1:

X=g(x)=X1, or

X=g(x)≤X1 is satisfied.

The composition ratio X at each position can include an error of ±10%. In the case of the above functions, the quantum efficiency can be improved because the energy for the region on the glass substrate side can be raised from the position of the peak of the energy in the lower end of the conduction band. The thickness D2 satisfies a substantially equal (error: ±50%) relationship (D2=DM±DM×50%) with the thickness DM. In the above embodiment, the intermediate region 1M, the first region 11, and the second region 12 are in contact with one another, however, an AlGaN layer which does not affect the characteristic can also be provided among them.

What is claimed is:

1. A semiconductor photocathode comprising:

an $Al_XGa_{1-X}N$ layer (0≤X<1) attached to a glass substrate via an $SiO_2$ layer; and an alkali metal-containing layer formed on the $Al_XGa_{1-X}N$ layer, wherein the $Al_XGa_{1-X}N$ layer includes:

a first region adjacent to the alkali metal-containing layer;

a second region adjacent to the $SiO_2$ layer; and an intermediate region located between the first region and the second region, wherein when a composition ratio is X=g(x), where x represents a location of the $Al_XGa_{1-X}N$ layer in a direction of thickness from the second region to the alkali metal-containing layer and a location of interface between the second region and the $SiO_2$ layer is furnished as an origin point of the position x, and when $X_{MIN(M)}$ represents a minimum value for the composition ratio X in the intermediate region and $X_{MIN(2)}$ represents a minimum value for the composition ratio X in the second region, in the first region, $0\le g(x)\le X_{MIN(M)}$ is satisfied, in the intermediate region, g(x) is a monotone decreasing function and $g(x)\le X_{MIN(2)}$ is satisfied, in the second region, g(x) is a monotone decreasing function or a constant value, in a case where g(x) in the second region is a monotone decreasing function, a thickness D1 of the first region is 18 (nm) or more, in a case where g(x) in the second region is a constant value, a thickness D1 of the first region is 31 (nm) or more, and g(x) is higher at a $SiO_2$ layer side than at a central position of the $Al_XGa_{1-X}N$ layer as measured in the direction of the thickness such that a peak position of a lowest energy level of a conduction band of the $Al_XGa_{1-X}N$ layer is closer to the $SiO_2$ layer than to the alkali metal-containing layer.

2. The semiconductor photocathode according to claim 1, wherein a total thickness D of the $Al_XGa_{1-X}N$ layer, a thickness DM of the intermediate region, a thickness D2 of the second region, and an allowable error E satisfy the following relational expressions:

$$(D2+DM)\times(100\pm E)\,\%=D/2,\text{ and}$$

$$E\le 60.$$

3. The semiconductor photocathode according to claim 1, wherein the minimum value $X_{MIN(2)}$ of the composition ratio X in the second region satisfies the following relational expression:

$$0.3\le X_{MIN(2)}\le 0.65.$$

4. The semiconductor photocathode according to claim 1, wherein the thickness D1 of the first region is 100 nm or less.

5. The semiconductor photocathode according to claim 2, wherein the minimum value $X_{MIN(2)}$ of the composition ratio X in the second region satisfies the following relational expression:

$$0.3\le X_{MIN(2)}\le 0.65.$$

6. The semiconductor photocathode according to claim 2, wherein the thickness D1 of the first region is 100 nm or less.

7. The semiconductor photocathode according to claim 3, wherein the thickness D1 of the first region is 100 nm or less.

8. The semiconductor photocathode according to claim 5, wherein the thickness D1 of the first region is 100 nm or less.

9. A semiconductor photocathode comprising:

an $Al_XGa_{1-X}N$ layer (0≤X<1) bonded to a glass substrate via an $SiO_2$ layer; and an alkali-metal-containing layer formed on the $Al_XGa_{1-X}N$ layer; and wherein the $Al_XGa_{1-X}N$ layer includes, a first region adjacent to the alkali-metal-containing layer, a second region adjacent to the $SiO_2$ layer, and an intermediate region positioned between the first region and the second region, the second region has a semiconductor superlattice structure formed by laminating a barrier layer and a well layer alternately, the intermediate region has a semiconductor superlattice structure formed by laminating a barrier layer and a well layer alternately, and a region of a pair of adjacent barrier and well layers is defined as a unit section, an average value of a composition ratio X of Al in a unit section decreases monotonously with distance from an interface position between the second region and the $SiO_2$ layer at least in the intermediate region, the average value of the composition ratio X of Al in a unit section in the second region is no less than a maximum value of the average value of the composition ratio X of Al in a unit section in the intermediate region, the average value of the composition ratio X of Al in the first region is no more than a minimum value of the average value of the composition ratio X of Al in a unit section in the intermediate region, and the composition ratio X of Al is higher at a $SiO_2$ layer side than at a central position of the $Al_XGa_{1-X}N$ layer as measured in the direction of the thickness such that a peak position of a lowest energy level of a conduction band of the $Al_XGa_{1-X}$ N layer is closer to the $SiO_2$ layer than to the alkali metal-containing layer.

10. The semiconductor photocathode according to claim 9, wherein the average value of the composition ratio X of Al in a unit section decreases monotonously with the distance from the interface position between the second region and the $SiO_2$ layer in the second region as well.

11. The semiconductor photocathode according to claim 9, wherein the average value of the composition ratio X of Al in a unit section is fixed along a thickness direction in the second region.

12. The semiconductor photocathode according to claim 9, wherein a total thickness D of the $Al_XGa_{1-X}N$ layer, a thickness DM of the intermediate region, a thickness D2 of the second region, and an allowable error E satisfy the following relational expressions:

$$(D2+DM)\times(100\pm E)\ \%=D/2,$$

$$E\leq 60.$$

13. The semiconductor photocathode according to claim 9, wherein a thickness D1 of the first region is no more than 100 nm.

14. A semiconductor photocathode comprising:

an $Al_XGa_{1-X}N$ layer ($0\leq X<1$) bonded to a glass substrate via an $SiO_2$ layer; and an alkali-metal-containing layer formed on the $Al_XGa_{1-X}N$ layer, the $Al_XGa_{1-X}N$ layer includes, a first region adjacent to the alkali-metal-containing layer, a second region adjacent to the $SiO_2$ layer, and an intermediate region positioned between the first region and the second region, the second region has a semiconductor superlattice structure formed by laminating a barrier layer and a well layer alternately, the intermediate region has a semiconductor superlattice structure formed by laminating a barrier layer and a well layer alternately, a region of a pair of adjacent barrier and well layers is defined as a unit section, an average value of a composition ratio X of Al in a unit section decreases with distance from an interface position between the second region and the $SiO_2$ layer at least in the intermediate region, and the composition ratio X of Al is higher at a $SiO_2$ layer side than at a central position of the $Al_XGa_{1-X}$ N layer as measured in the direction of the thickness such that a peak position of a lowest energy level of a conduction band of the $Al_XGa_{1-X}N$ layer is closer to the $SiO_2$ layer than to the alkali metal-containing layer.

15. A semiconductor photocathode comprising:

an $Al_XGa_{1-X}N$ layer ($0\leq X<1$) bonded to a glass substrate via an $SiO_2$ layer; and an alkali-metal-containing layer formed on the $Al_XGa_{1-X}N$ layer; and wherein the $Al_XGa_{1-X}N$ layer includes a first region adjacent to the alkali-metal-containing layer, a second region adjacent to the $SiO_2$ layer, and an intermediate region positioned between the first region and the second region, wherein an effective Al composition ratio X(11) in the first region satisfy $0(\%)\leq X(11)\leq 30(\%)$, a constant effective Al composition ratio X in the second region satisfy $15(\%)\leq X\leq X(11)+50(\%)$, and the effective Al composition ratio X is higher at a $SiO_2$ layer side than at a central position of the $Al_XGa_{1-X}N$ layer as measured in the direction of the thickness such that a peak position of a lowest energy level of a conduction band of the $Al_XGa_{1-X}N$ layer is closer to the $SiO_2$ layer than to the alkali metal-containing layer.

16. A semiconductor photocathode comprising:

an $Al_XGa_{1-X}N$ layer ($0\leq X<1$) bonded to a glass substrate via an $SiO_2$ layer; and an alkali-metal-containing layer formed on the $Al_XGa_{1-X}N$ layer, wherein the $Al_XGa_{1-X}N$ layer includes, a first region adjacent to the alkali-metal-containing layer, a second region adjacent to the $SiO_2$ layer, and an intermediate region positioned between the first region and the second region, and wherein an effective Al composition ratio X(11) in the first region satisfy $30(\%)\leq X(11)\leq 40(\%)$, a constant effective Al composition ratio X in the second region satisfy $60(\%)\leq X\leq X(11)+50(\%)$, and the effective Al composition ratio X is higher at a $SiO_2$ layer side than at a central position of the $Al_XGa_{1-X}N$ layer as measured in the direction of the thickness such that a peak position of a lowest energy level of a conduction band of the $Al_XGa_{1-X}N$ layer is closer to the $SiO_2$ layer than to the alkali metal-containing layer.

17. A semiconductor photocathode comprising:

an $Al_XGa_{1-X}N$ layer ($0\leq X\leq 1$) bonded to a glass substrate via an $SiO_2$ layer; and an alkali-metal-containing layer formed on the $Al_XGa_{1-X}N$ layer wherein the $Al_XGa_{1-X}N$ layer includes, a first region adjacent to the alkali-metal-containing layer, a second region adjacent to the $SiO_2$ layer, and an intermediate region positioned between the first region and the second region, the second region has a semiconductor superlattice structure formed by laminating a barrier layer and a well layer alternately, the intermediate region has a semiconductor superlattice structure formed by laminating a barrier layer and a well layer alternately, a region of a pair of adjacent barrier and well layers is defined as a unit section, an average value of a composition ratio X of Al in a unit section decreases monotonously with distance from an interface position between the second region and the $SiO_2$ layer at least in the intermediate region, the average value of the composition ratio X of Al in a unit section in the second region is no less than a maximum value of the average value of the composition ratio X of Al in a unit section in the intermediate region, the average value of the composition ratio X of Al in the first region is no more than a minimum value of the average value of the composition ratio X of Al in a unit section in the intermediate region, and the composition ratio X of Al is higher at a $SiO_2$ layer side than at a central position of the $Al_xGa_{1-x}N$ layer as measured in the direction of the thickness such that a peak position of a lowest energy level of a conduction band of the $Al_xGa_{1-x}N$ layer is closer to the $SiO_2$ layer than to the alkali metal-containing layer.

18. An electron tube comprising:

the semiconductor photocathode according to any one of claims 1, 2, 3, 4, 9 to 13, 14 to 17, and 5 to 8;

an anode collecting electrons emitted from the semiconductor photocathode in response to incidence of light; and an enclosure housing an electron emission surface of the semiconductor photocathode and the anode inside a reduced-pressure environment.

19. An image intensifier tube comprising:

the semiconductor photocathode according to any one of claims 1, 2, 3, 4, 9 to 13, 14 to 17, and 5 to 8;

a microchannel plate facing an electron emission surface of the semiconductor photocathode;

a phosphor screen facing the microchannel plate; and an enclosure housing the electron emission surface of the semiconductor photocathode, the microchannel plate, and the phosphor screen inside a reduced-pressure environment.

* * * * *